United States Patent [19]

Hirano et al.

[11] Patent Number: 4,707,159

[45] Date of Patent: Nov. 17, 1987

[54] SERIAL PRINTER INCLUDING A LATERALLY RECIPROCABLE RECORDING HEAD, PAPER BAIL CONTROL, PAPER DETECTION AND FEEDING MEANS, A MULTICOLOR INK RIBBON INCLUDING A HEAD CLEANING ZONE, A RIBBON CASSETTE AND RIBBON SHIFT MEANS

[75] Inventors: Hirofumi Hirano; Masaaki Nakamura; Hitoshi Hasumi; Shoichi Inoue; Akiteru Furukawa, all of Chichibu, Japan

[73] Assignee: Canon Kabushiki Kaisha, Tokyo, Japan

[21] Appl. No.: 758,129

[22] Filed: Jul. 23, 1985

[30] Foreign Application Priority Data

| | | | |
|---|---|---|---|
| Jul. 26, 1984 | [JP] | Japan | 59-154140 |
| Jul. 26, 1984 | [JP] | Japan | 59-154142 |
| Oct. 1, 1984 | [JP] | Japan | 59-204037 |
| Oct. 1, 1984 | [JP] | Japan | 59-204038 |
| Oct. 1, 1984 | [JP] | Japan | 59-204039 |
| Oct. 1, 1984 | [JP] | Japan | 59-204040 |

[51] Int. Cl.[4] ..... B41J 13/20

[52] U.S. Cl. ..... 400/639.1; 400/196.1; 400/208; 400/216.1; 400/240; 400/240.4; 400/605; 400/607; 400/633.2; 400/702; 400/902; 400/903; 400/708

[58] Field of Search ..... 400/194, 195, 196, 196.1, 400/207, 208, 208.1, 216.1, 216.2, 216.3, 217, 217.1, 229, 240, 240.3, 240.4, 247, 248, 605, 607.2, 619, 633, 633.1, 633.2, 637.1, 639.1, 639.2, 695, 696, 697, 697.1, 701, 702, 702.1, 707.5, 708, 708.1, 710, 902, 903, 583.3

[56] References Cited

U.S. PATENT DOCUMENTS

| | | | |
|---|---|---|---|
| 1,594,785 | 8/1926 | Lindburg | 400/633.1 X |
| 1,905,118 | 4/1933 | Nadell | 400/696 |

(List continued on next page.)

FOREIGN PATENT DOCUMENTS

| | | | |
|---|---|---|---|
| 3146242 | 5/1983 | Fed. Rep. of Germany | 400/702 |
| 3210723 | 10/1983 | Fed. Rep. of Germany | 400/216.1 |
| 0007076 | 1/1978 | Japan | 400/708 |
| 0032603 | 3/1980 | Japan | 400/708 |
| 0126470 | 9/1980 | Japan | 400/637.1 |
| 0128484 | 10/1980 | Japan | 400/702 |
| 0164184 | 12/1980 | Japan | 400/707.5 |
| 0167487 | 12/1981 | Japan | 400/710 |
| 0074186 | 5/1982 | Japan | 400/708 |
| 0098385 | 6/1982 | Japan | 400/196.1 |
| 0152982 | 9/1982 | Japan | 400/708 |
| 0001588 | 1/1983 | Japan | 400/701 |
| 0084788 | 5/1983 | Japan | 400/208 |
| 0021278 | 2/1985 | Japan | 400/639.1 |

OTHER PUBLICATIONS

IBM Technical Disclosure Bulletin, "Automatic Bail Control", Garcia et al, vol. 23, No. 1, Jun. 1980, pp. 7–8.

IBM Technical Disclosure Bulletin, "Automatic Printhead Cleaner", Bowlds et al, vol. 26, No. 3B, Aug. 1983, pp. 1586–1587.

*Primary Examiner*—Ernest T. Wright, Jr.

*Attorney, Agent, or Firm*—Spencer & Frank

[57] ABSTRACT

A printer for performing recording successively while a recording head moves backwards and forwards in a predetermined direction with respect to a recording medium such as paper. A paper hold roller for pressing the recording medium against a platen in the vicinity of a recording area opposite to a print head is detachable from the platen in relation to the movement of a carriage for carrying the recording head. The presence and absence of paper is detected to control the paper feed. An ink ribbon is provided which has color zones and an ink absorption zone in the direction of the ribbon width for multi-color printing by shifting the ribbon in the width direction by means of the carriage movement so that a selected color zone faces the recording head. The printer further includes a ribbon cassette, means for controlling paper insertion and feeding and means for cleaning the recording head. Also included are a paper bail control, color zone selector and paper detector.

14 Claims, 29 Drawing Figures

U.S. PATENT DOCUMENTS

| | | | |
|---|---|---|---|
| 2,110,855 | 3/1938 | Fyfe et al. | 400/583.3 |
| 2,386,439 | 10/1945 | Cordis | 400/248 |
| 2,873,015 | 2/1959 | Gray | 400/248 X |
| 3,872,961 | 3/1975 | St. James | 400/702 |
| 3,988,744 | 10/1976 | Noda | 400/708 X |
| 4,164,376 | 8/1979 | Yarp | 400/605 X |
| 4,165,188 | 8/1979 | Rempel | 400/248 X |
| 4,268,021 | 5/1981 | Rutishauser et al. | 400/708 X |
| 4,273,457 | 6/1981 | Noda | 400/633.2 X |
| 4,280,767 | 7/1981 | Heath | 400/216.2 |
| 4,368,993 | 1/1983 | Brass et al. | 400/217 X |
| 4,391,540 | 7/1983 | Dougherty | 400/216.1 X |
| 4,407,595 | 10/1983 | Gershnow | 400/208 X |
| 4,425,046 | 1/1984 | Van Horne et al. | 400/212 X |
| 4,452,543 | 6/1984 | Adkisson et al. | 400/639.1 X |
| 4,469,454 | 9/1984 | Crean | 400/708 X |
| 4,492,484 | 1/1985 | Akazawa et al. | 400/248 |
| 4,498,795 | 2/1985 | Tatara | 400/637.1 |
| 4,500,023 | 2/1985 | Akazawa | 400/633 X |
| 4,540,299 | 9/1985 | Yamada | 400/708 |
| 4,543,002 | 9/1985 | Bittner et al. | 400/216.1 X |
| 4,568,209 | 2/1986 | Zerillo | 400/216.1 |

SERIAL PRINTER INCLUDING A LATERALLY RECIPROCABLE RECORDING HEAD, PAPER BAIL CONTROL, PAPER DETECTION AND FEEDING MEANS, A MULTICOLOR INK RIBBON INCLUDING A HEAD CLEANING ZONE, A RIBBON CASSETTE AND RIBBON SHIFT MEANS

BACKGROUND OF THE INVENTION

1. Field of the Invention

This invention relates to a printer, and more particularly to a serial printer in which a recording head is reciprocated in a predetermined direction against a recording medium such as paper so that recording is performed successively on a recording medium by such movement.

2. Description of the Prior Art

Although this type of printer is widely used because of its low price, such printers involve extremely complex operations for the initial setting of fan-fold paper that has perforations between sheets, for the positioning of the leading edges of cut sheets, and the positioning in a left-to-right direction of such recording papers.

Printers are known that overcome these defects having various auto-paper setting functions, but these printers have the defects of an extremely complex mechanism and high cost.

FIG. 1 shows an arrangement of a conventional printer.

In FIG. 1, reference numeral 101 denotes a platen. A recording head 102 is disposed opposite the platen 101. A paper hold roller 103 is in contact with the recording head 102 side of the platen 101 at an upper position. The paper hold roller 103 is installed rotatably on a shaft 104. The shaft 104 is supported at both ends by arms 105.

The bottom edges of the arms 105 are fixed to a rotatable shaft 109 that also acts as a guide shaft for a carriage. The shaft 109 is fixed to a top edge of a lever 113. A bottom edge of the lever 113 is coupled to a rod 112*a* of a solenoid 112.

A paper pan 106 is disposed underneath the platen 101. A pinch roller 107 is disposed underneath the paper pan 106. A supporting shaft 108 of the pinch roller 107 applies force to approach the platen 101 side by a spring (not shown). The pinch roller 107 passes through an opening 106A formed by the paper pan 106, and comes into contact with the platen 101.

A paper-edge setting lever 110 is disposed substantially below the platen 101 underneath the paper pan 106 with one of its ends fixed to a shaft 111.

The edge of the paper-edge setting lever 110 comes into contact with the platen 101 through the opening 106A formed by the paper pan 106. As described below, the edge of the paper-edge setting lever 110 touches the edge of a recording paper 114*a* or 114*b* and keeps that edge parallel to a shaft 101*a* of the platen 101.

To the other side of the platen 101, a pin-wheel 117 is disposed at a predetermined distance from the paper pan 106. The pin-wheel 117 has a plurality of pins 117*a* disposed around its circumference. The pin-wheel 117 is fixed to a shaft 119.

Reference numeral 114*a* denotes a fan-fold paper which has feed holes as shown in FIG. 11B as reference numeral 56*h* that engage with the pins 117*a* formed along both edges at pitch. The pins 117*a* are engageable in these holes 56 *h*.

After the fan-fold paper 114*a* has been set on the pin-wheel 117, it is held down by a cover 118 so that it does not come away from the pins 117*a*.

A paper guide 115 is disposed on top of the paper pan 106. The paper guide 115 guides a cut sheet 114*b* and has a positioning member 116 that aligns with the width of the paper 114*b* slidably mounted at one end.

Reference numeral, 106*a* denotes a paper pan for cut sheet paper 114*b*.

Recording paper is set on to the above arrangement as follows.

First, to set a cut sheet 114*b*, the positioning member 116 is slid to a predetermined position to align with the gradations on the paper guide 115. Then, an off-line switch or the like on a keyboard (not shown) is pressed, so that the printer is in an off-line mode with respect to a host device for instance.

Next, a paper set lever (not shown) is rotated, and the pinch roller 107 is moved away from the platen 101. At this time, the paper-edge setting lever 110 engages and presses on the platen 101.

Next, through the paper guide 115, the cut-sheet 114*b* is inserted between the paper pan 106*a* and the platen 101, and is stopped against the paper-edge setting lever 110. Next, the paper set lever is operated, so that the pinch roller 107 presses against the platen 101, and the cut-sheet 114*b* is held between the platen 101 and the roller 107.

When the paper set key on the keyboard is pressed in this condition, current is supplied to the solenoid 112 so that a rod 112*a* is drawn in, and the arm 105 is rotated in the clockwise direction in the drawing through a lever 113, and the paper hold roller 103 moves away from the platen 101.

At the same time, the paper-edge setting lever 110 also moves away from the platen 101. Next, after the platen 101 rotates in a counterclockwise direction in the drawing, and the cut-sheet 114*b* has been fed for a predetermined distance, the current to the solenoid 112 is interrupted, and the paper hold roller 103 presses against the platen 101 holding the edge of the recording paper.

Then, the setting of the cut sheet paper 114*b* is completed.

The procedure for setting cut-sheet paper 114*b* as described above involves the following steps:

(1) Pressing the off-line switch.
(2) Operating the paper set lever.
(3) Inserting the recording paper.
(4) Operating the paper set lever.
(5) Pressing the paper set key.

Consequently, conventional printers are expensive due to their complex mechanisms, and are relatively difficult to operate because of the complicated operation involved.

To set the fan-fold paper 114*a*, a lock-lever (not shown) is released, the pin-wheel 117 is slid along the shaft 119 , the cover 118 is opened, the holes 56*h* along both edges of the fan-fold paper 114*a* are aligned with the pin 117*a* and the cover 118 is closed. The space between the pin-wheels 117 is adjusted so that the fan-fold paper 114*a* does not crumple, and then the lock lever is operated to lock the pin-wheels 117.

Next, the paper set lever (not shown) is operated, and the pinch roller 107 moves away from the platen 101. At this time, the paper-edge setting lever 110 does not engage.

Then, the paper hold roller 103 is lifted manually, and after the off-line switch (not shown) is pressed, the line-feed button is pressed to rotate the pinwheel 117 and the fan-fold paper 114*a* is fed until it passes the paper hold roller 103.

In this condition, bringing down the paper hold roller 103 manually, and operating the paper feed knob (not shown) in an appropriate forward feed direction or a reverse feed direction aligns the position of the edge of the fanfold paper 114*a* and completes the setting.

If the power supply is turned off when the setting of the fan-fold paper 114*a* has been completed and the printer is reset, referring the position of the edge of the fan-fold paper 114*a* each page will be fed to a top of form by a form-feed switch or a program according to a paper length set by a DIP (dual-in-line package) switch or a program.

However, setting of the fan-fold paper 114*a* involves many manual operations for aligning the position of pin-wheel 117 or the position of the top edge of the paper 114*a* with gradations or by guess-work, resulting in an extremely complex operation.

Furthermore, after setting the paper 114*a*, feeding the paper 114*a* forwards or backwards even once with the paper feed knob misaligns the standard of the top edge of the fan-fold paper 114*a*, so that the page will not feed to the top of the form correctly thereafter.

Moreover, because conventional printers require a drive means such as a solenoid 112 to move the paper hold roller 103 away from the platen 101, the construction becomes complicated and excessive electrical power is required so that both the price of the device itself and the operating costs are high.

Furthermore, on printers which use an ink ribbon in the recording system, an arm or other guide member for guiding the ink ribbon close to the recording head 102 is fitted to an ink ribbon cassette which accomodates the ink ribbon, so that the ink ribbon cassette has a large overall size and requires a large amount of storage space, and safety and operability are impaired by the arm or other guide member knocking against other members.

Moreover, on printers for multi-colored printing that use multi-colored ink ribbons, a complex arrangement is required for the selection of the color. Because such printers also require a drive source such as a solenoid to operate the mechanism, they are expensive because of the large number of parts required.

SUMMARY OF THE INVENTION

It is, therefore, an object of the present invention to provide a printer which can prevent the abovementioned disadvantages of the conventional printer.

It is another object of the present invention to provide a printer with a simple arrangement and a reduced number of parts, thereby having an inexpensive price and superior operability.

It is a further object of the present invention to provide a printer which is arranged so that when setting recording paper, a paper hold roller can be moved away from a platen without the need for a special drive source.

It is a still further object of the present invention to provide a printer in which the construction of the cassette can be simplified, thereby reducing the size of an ink ribbon cassette and improving safety and operability.

It is a still further object of the present invention to provide a printer which can select a color of an ink ribbon by linking with the movement of a carriage which mounts a recording head without the need for a solenoid or other special drive source.

In order to achieve these objects, in a first aspect of the present invention, a printer comprises:

a recording head for performing recording on a recording medium;

a carriage carrying the recording head for reciprocating the recording head in a predetermined direction;

a platen extending in the predetermined direction, and for controlling the recording medium to form a recording area opposite to the recording head;

a holding member for pressing the recording medium against the platen in the vicinity of the recording area;

a supporting member for supporting the holding member in a manner that the pressing member can be pressed against and detached from the platen; and a drive member for driving the supporting member at a predetermined position of the carriage so that the holding member is disengaged from the platen.

Here, the platen may be in the form of a platen roller for feeding the recording member. The holding member may have a shaft extending parallel with the platen roller, and a holding roller mounted on the shaft opposite to the platen roller. The supporting member may include a pair of arm members which supports both ends of the shaft and which can rotate in a first direction in which the holding roller is pressed against the platen roller, and in a second direction in which the holding roller is detached from the platen roller, and an energizing member for energizing the pair of arm members toward the first direction. The drive member may have an engaging member which can engage with a portion of one arm member of the pair of arm members, and which can rotate the pair of arm members in the second direction against an energizing force of the energizing member when the engaging member engages with the portion of the one arm members.

The engaging member may be disposed on the carriage, and the predetermined position may be a position in the vicinity of the one arm member, at which the engaging member engages with the portion of the one arm member.

Alternatively, the engaging member may be disposed in the vicinity of the one arm member and can drive in the engaging direction, and the drive member may have a drive control member which is disposed on the carriage to control the engaging member in the engaging direction.

In a second aspect of the present invention, a printer comprises:

a recording head for performing recording on a recording medium;

a platen roller extending in a predetermined direction for controlling the recording medium to form a printing area opposite the recording head;

a pinch roller for holding the recording medium with the platen roller and for co-operating with the platen roller to feed the recording medium; and means for detecting the recording medium disposed between the recording area and the position at which the pinch roller and the platen roller hold the recording medium therebetween.

Here, the detecting means may have a light reflecting type photosensor. The photosensor may be disposed at a position opposite to feed holes in a recording medium, so that the insertion of the recording medium having the feed holes is detected by a detecting output from the photosensor. The number of feed holes may be counted by the detecting output from the photosensor, so that the transport of the recording medium having the feed holes is controlled by the counting result.

In a third aspect of the present invention, a printer comprises:

a recording head for performing recording on a recording medium;

a platen extending in a predetermined direction for controlling the recording medium so that the recording medium is opposite to the recording head;

a transporting member for transporting the recording medium to a position opposite to the recording head on the platen;

a shaft extending in the predetermined direction;

a pair of left and right guide members movable along the shaft, for guiding a right edge and a left edge of a loaded recording medium to the transporting member; and means mounted on an at least one guide member of the pair of left and right guide members for detecting the recording medium.

Here, the platen may be in the form of a platen roller for feeding the recording medium. The transporting member may be in the form of a pinch roller which holds the recording medium with the platen roller and co-operates with the platen roller to feed the recording medium. At least one of the guide members may have an attachment member for attaching the detecting means between a position opposite to the recording head and a position at which the platen roller and the pinch roller hold the recording medium therebetween. The shaft may have a groove disposed corresponding to the width of a recording medium to be inserted, and the pair of left and right guide members may have a member that can engage with the groove.

The detecting means may have a light reflecting type photosensor. The photosensor may be disposed at a position opposite to feed holes in a recording medium, so that the insertion of the recording medium having the feed holes is detected by a detecting output from the photosensor. The number of feed holes may be counted by the detecting output from the photosensor, so that the transport of the recording medium having the feed holes is controlled by the counting result.

In a fourth aspect of the present invention, a printer comprises:

a recording head for performing recording on a recording medium;

a platen extending in a predetermined direction for controlling the recording medium to form a recording area opposite to the recording head;

means for transporting the recording medium to a position opposite to the recording head;

a holding member for pressing the recording member against the platen in the vicinity of the recording area;

a supporting member for supporting the holding member in a manner that the holding member can be pressed against and detached from the platen;

means for driving the supporting member to press the holding member against and detaching the holding member from the platen;

means for detecting the presence of the recording medium;

means for controlling the drive means and the transporting means according to a set command when no insertion of the recording medium is detected by the detecting means to set a loaded recording medium by performing setting processing including processing to detach the holding member from the platen, processing to drive the transporting means and processing to press the holding member against the platen; and means for issuing the set command to the control means to perform the setting processing.

Here, the commanding means may be in the form of a feed switch for instructing transporting of the recording medium loaded to the transporting means. The control means may control the transporting means to transport the loaded recording medium by a fixed amount or to transport continuously the loaded recording medium according to an operating condition of the feed switch when the detecting means detects the insertion of the recording medium. The platen may be in the form of a platen roller for feeding the recording medium. The transporting means may include a pinch roller for holding the recording medium with the platen roller and for co-operating with the platen roller to transport the recording medium.

In a fifth aspect of the present invention, a printer comprises:

a cassette supporting member for detachably supporting an ink ribbon cassette having a containing portion for containing an ink ribbon in a manner that the containing ink ribbon is exposed between an outlet and an inlet of the containing portion;

a recording head for performing recording, the recording head contacting a recording medium via the ink ribbon;

a guide member for guiding the exposed ink ribbon to a position opposite to the recording head;

a carriage for carrying the recording head to reciprocate the recording head with respect to the recording medium in a predetermined direction; and means for moving the guide member in accordance with the reciprocating movement of the carriage.

Here, the cassette support member may have a feed member for feeding the ink ribbon. The recording head and the guide member may be mounted on a carriage reciprocating in the predetermined direction with respect to the recording medium. A position of the guided ink ribbon can be modified with respect to the recording head. The ink ribbon may have a plurality of color band regions in the transversal direction of the ink ribbon, and either one of the color band regions may be positioned opposite to the recording head by changing the position of the guide member.

In a sixth aspect of the present invention, a printer comprises:

a cassette supporting member for detachably supporting an ink ribbon cassette having a containing portion for containing an ink ribbon in a manner that the contained ink ribbon is exposed between an outlet and an inlet of the containing portion;

a recording head for performing recording, the recording head contacting a recording medium via the ink ribbon;

a guide member for guiding the exposed ink ribbon to a position opposite to the recording head;

a displacing member for supporting the guide member and displaceable to change the position of the guided ink ribbon opposite to the recording head;

a locking member which can lock the guide member at a plurality of positions;

a carriage for carrying the recording head, the locking member and the displacing member to reciprocate with respect to the recording medium in a predetermined direction; and an opposing position changing member which engages with the locking member within a predetermined range of positions of movement of the carriage to change the opposing position by displacing the displacing member in response to the engagement.

Here, the cassette support member may have a feed member for feeding the ink ribbon. The opposing position changing member may have a cam member for changing a locking position by the locking member in relation to a position of movement within the predetermined range of the carriage. The ink ribbon may have a plurality of color band zones in the transversal direction of the ink ribbon, and either one of the color band zones may be positioned opposite to the recording head in response to a change in the locking position. The ink ribbon may have a cleaning band for cleaning recording end portions of the recording head, and the opposing position changing member may have a member for disengaging the locking by the locking member at a position preceding the entrance of the carriage into the predetermined range, so that the cleaning band may be positioned opposite to the recording head in response to the release of the locking member.

In a seventh aspect of the present invention, a printer comprises:

a cassette supporting member for detachably supporting an ink ribbon cassette having a containing portion for containing an ink ribbon in a manner that the containing ink ribbon is exposed between an outlet and an inlet of the containing portion;

a recording head for performing recording, the recording head contacting a recording medium via the ink ribbon;

a guide member for guiding the exposed ink ribbon to a position opposite to the recording head;

a displacing member for supporting the guide member and displaceable to change the position of the guided ink ribbon opposite to the recording head;

a locking member which can lock the guide member at a plurality of positions;

a carriage for carrying the recording head, the locking member and the displacing member to reciprocate with respect to the recording medium in a predetermined direction;

an opposing position changing member which engages with the locking member within a predetermined range of positions of movement of the carriage to change the opposing position by displacing the displacing member in response to the engagement;

a platen extending in the predetermined direction, and for controlling the recording medium to form a recording area opposite to the recording head;

a holding member for pressing the recording medium against the platen in the vicinity of the recording area;

a supporting member for supporting the holding member in a manner that the pressing member can be pressed against and detached from the platen; and a drive member for driving the supporting member at a predetermined position of the carriage so that the holding member is detected from the platen.

Here, the platen may be in the form of a platen roller for feeding the recording member. The holding member may have a shaft extending in parallel to the platen roller, and a holding roller mounted on the shaft opposite to the platen roller. The supporting member may include a pair of arm members which supports both ends of the shaft and which can rotate in a first direction in which the holding roller is pressed against the platen roller, and in a second direction in which the holding roller is detached from the platen roller, and an energizing member for energizing the pair of arm members toward the first direction. The drive member may have an engaging member which can engage with a portion of one arm member of the pair of arm members, and which can rotate the pair of arm members in the second direction against an energizing force of the energizing member when the engaging member engages with the arm portion. The engaging member may be disposed in the vicinity of the one arm member and can drive in the engaging direction, and the drive member may have a drive control member which is disposed on the carriage to control the engaging member in the engaging direction.

The opposing position changing member may have a cam member for changing a locking position by the locking member in relation to a position of movement within the predetermined range of the carriage. The ink ribbon may have a plurality of color band zones in the transversal direction of the ink ribbon, and either one of the color band zones may be positioned opposite to the recording head in response to a change in the locking position. The ink ribbon may have a cleaning band for cleaning recording end portions of the recording head, and the opposing position changing member may have a member for disengaging the locking by the locking member at a position preceding the entrance of the carriage into the predetermined range so that the cleaning band may be positioned opposite to the recording head in response to the release of the locking member.

The drive control member may be mounted on the displacing member, so that the drive control member engages with the engaging member when the carriage has moved to the predetermined position under the condition that the locking is released.

In an eighth aspect of the present invention, a printer comprises:

a recording head for performing recording;

means for feeding fan-fold paper to the recording head;

means disposed at a position where the means detects holes in the fan-fold paper being fed by the feeding means, and for detecting a presence of the fan-fold paper or the number of holes; and means controlling the feeding means in accordance with a detection result from the detecting means.

Here, feeding means may be a pin-feed tractor.

In a ninth aspect of the present invention, a printer comprises:

an ink ribbon having a plurality of color zones:

a recording head for printing on a recording paper;

means for cleaning a striking surface of the recording head; and means for controlling the cleaning means so that printing is performed after the striking surface of the recording head has been cleaned by the cleaning means when printing is performed with different colors by the recording head.

Here, the cleaning means may be formed integrally with the ink ribbon as an ink absorption zone. Further, a carriage for carrying the recording head and reciprocating the recording head, and means for shifting each of the zones of the ink ribbon so that each zone is selectively opposite to the recording head in response to the movement of the carriage may be provided.

The above and other objects, effects, features and advantages of the present invention will become more apparent from the following description of preferred embodiments thereof taken in conjunction with the accompanying drawings.

DETAILED DESCRIPTION OF PREFERRED EMBODIMENTS

Figure 1:
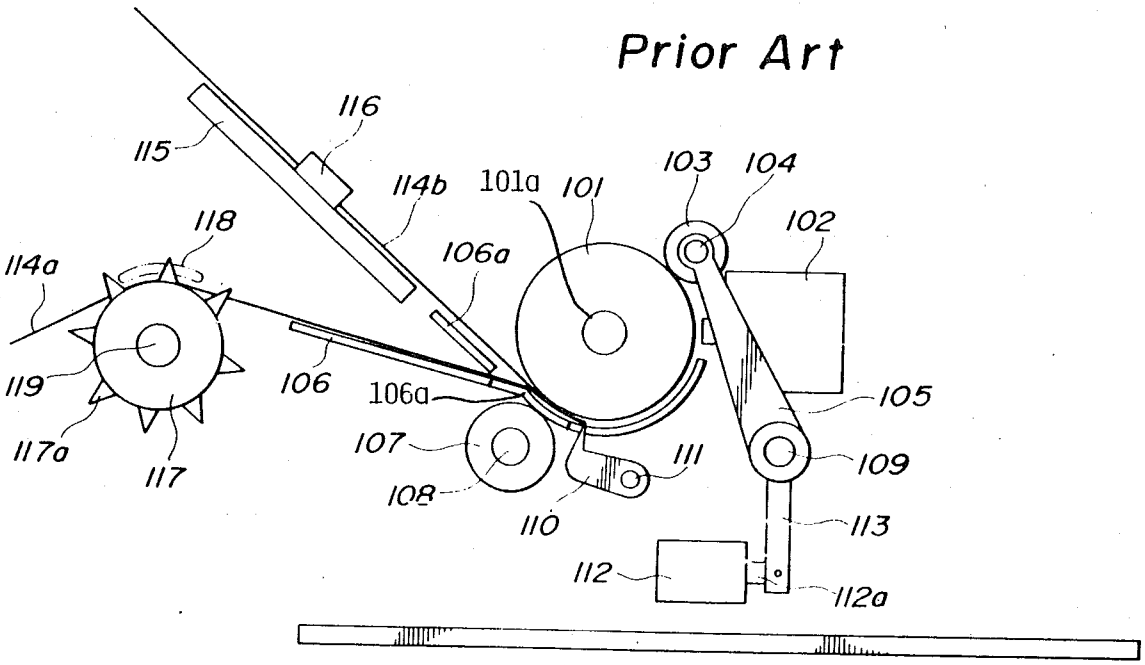
FIG. 1 Prior Art
FIG. 1 is a side view showing an arrangement of principal parts in a conventional printer.
Figure 2:
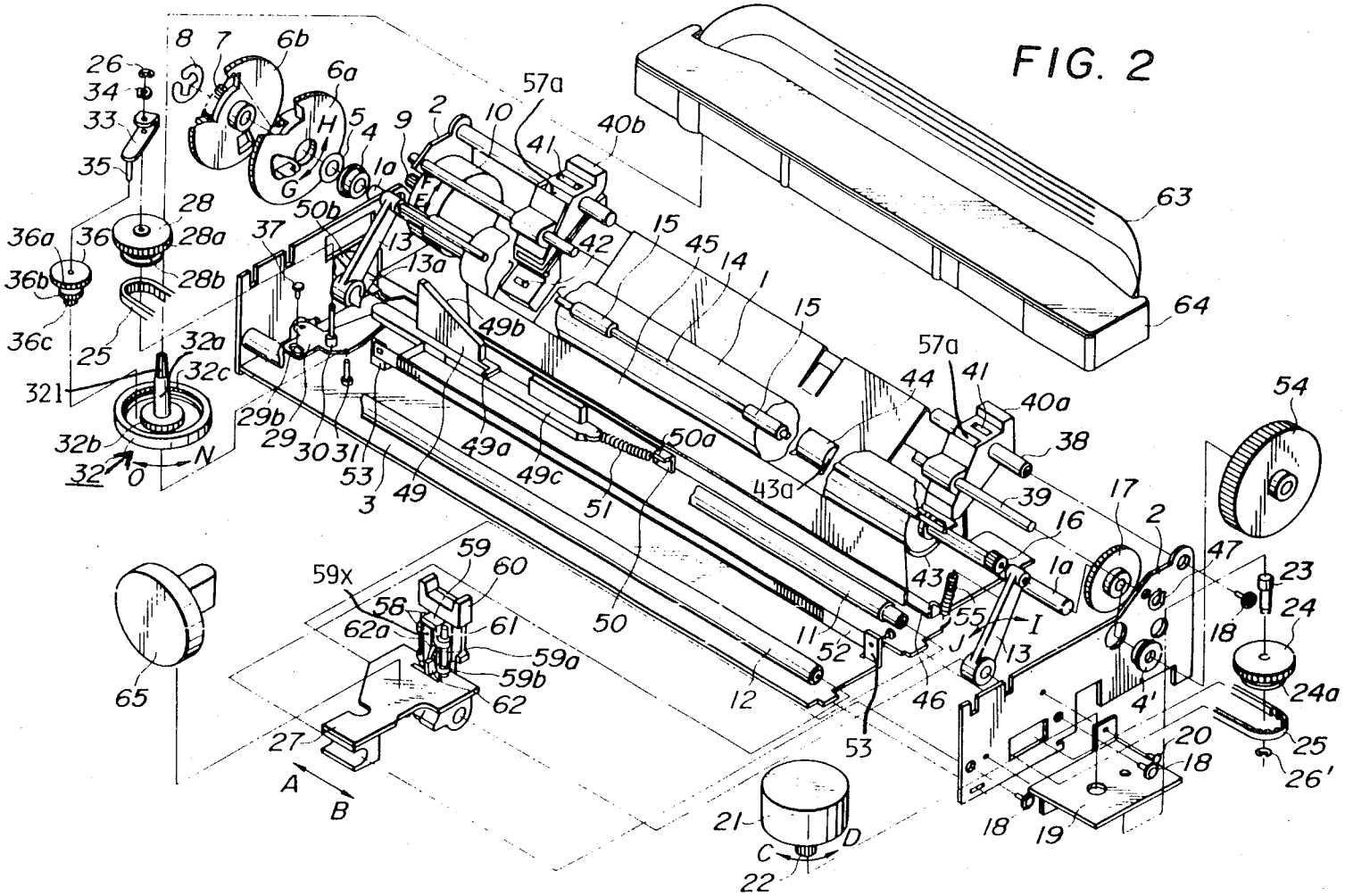
FIG. 2 is a perspective view showing an embodiment of a printer according to the present invention.
Figure 3:
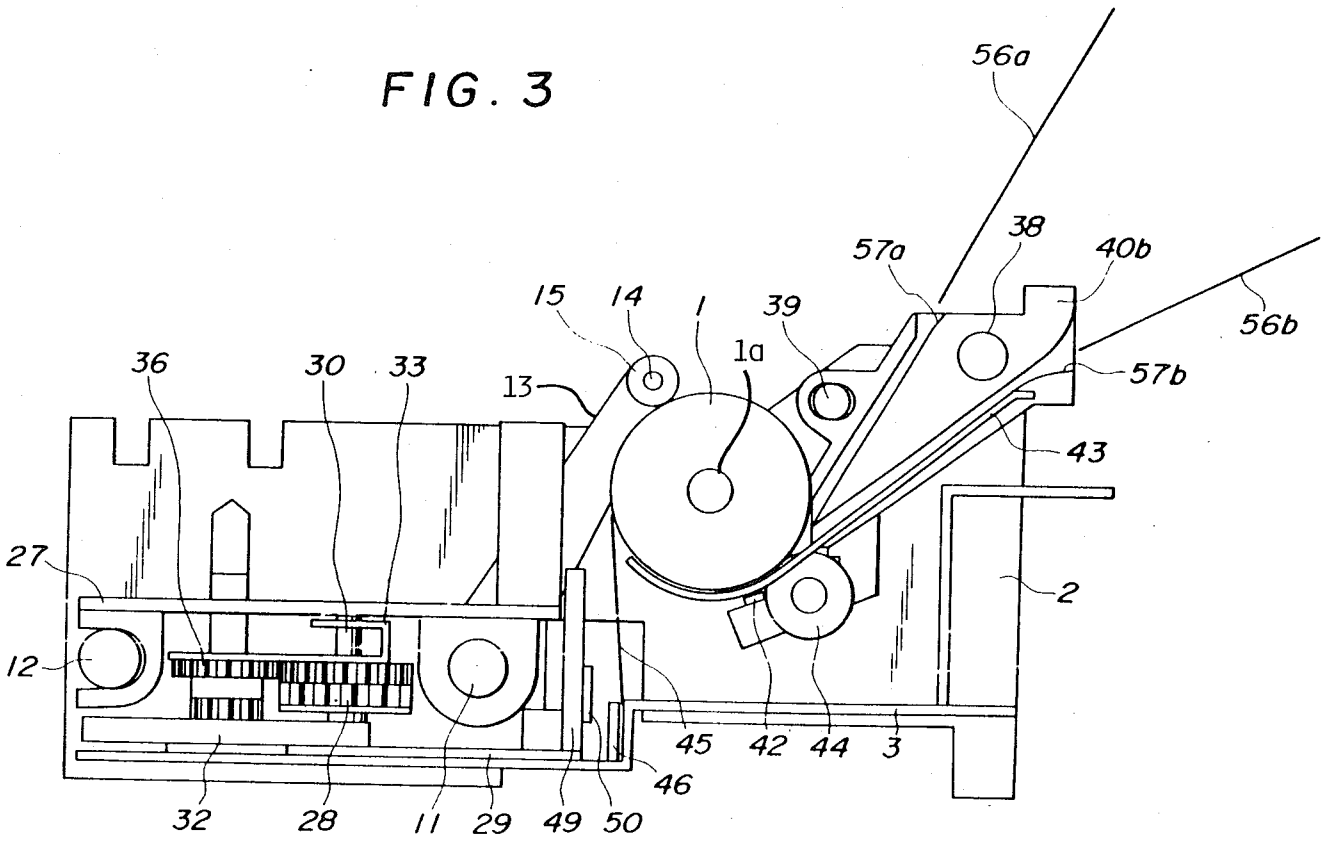
FIG. 3 is a side view showing the substantial parts of the printer shown in FIG. 2.

FIG. 2 and FIG. 3 show an embodiment of a printer according to the present invention. Reference numeral 1 in FIGS. 2 and 3 is a platen. The platen 1 is rotatably supported by a platen shaft 1*a* supported between side plates 2 and 2 fixed on both sides of a base plate 3.

A boss 4 is fixed to the left end of the platen shaft 1*a*. Paper feed gears 6*a* and 6*b* are fixed to the platen shaft 1*a* through the boss 4 and a washer 5.

Reference numeral 8 denotes a retaining ring to prevent the paper feed gears 6*a* and 6*b* from falling off.

A spring 7 is stretched between gears 6*a* and 6*b* applying a force to turn gears 6*a* and 6*b* in opposite directions to each other.

Figure 4:
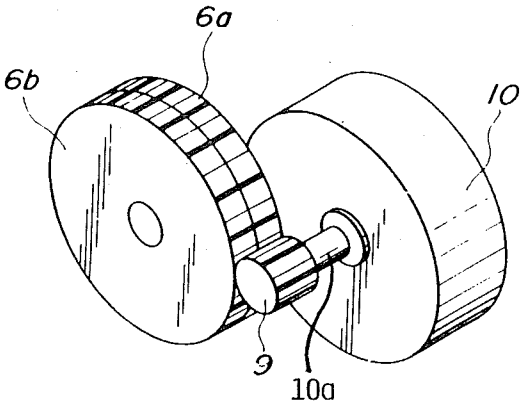

These two paper feed gears 6*a* and 6*b* are engaged with a pinion gear 9 fixed to an output shaft 10*a* (see FIG. 4) of a paperfeeding pulse motor 10 as shown in FIG. 4 that is fixed on the side plate 2.

Figure 5:
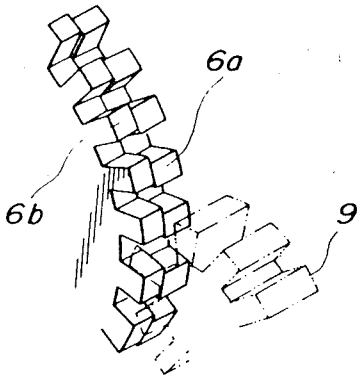
FIGS. 4 and 5 are perspective views showing an engagement of gears for feeding paper in FIG. 2.

The spring 7 applies rotating force to the two gears 6*a* and 6*b* in respectively opposite directions. Therefore, when the gears 6*a* and 6*b* engage with the pinion gear 9, since the teeth of the gears 6*a* and 6*b* rotate respectively in opposite directions as shown in FIG. 5, they are held at the back and the front by the teeth of the pinion gear 9, so that the backlash of the gears 6*a* and 6*b* is reduced.

Reference numerals 11 and 12 in FIG. 2 denote guide shafts for a carriage 27 described below, and are fixed at both ends to the side plates 2 and 2 by screws 18.

The bottom ends of arms 13 and 13 are rotatably supported on both ends respectively of the guide shaft 11.

A shaft 14 is rotatably supported between the top ends of arms 13 and 13. A plurality of paper hold rollers (pinch rollers) 15 are mounted on this shaft 14.

A paper hold gear 16 is fixed at one end of the shaft 14. The gear 16 engages with a gear 17 fixed on one end of the platen shaft 1*a*.

Between the arm 13 and the base plate 3, a spring 55 is stretched for pulling the arm 13 towards the platen 1 so that the paper hold roller 15 presses on to the platen 1.

A support plate 19 is fixed to the outside of the right side plate 2 by a screw 20. A stepping motor 21 for driving the carriage 27 is supported on top of the support plate 19. A pinion gear 22 is attached on the output shaft of the stepping motor 21 which protrudes beneath the support plate 19.

A gear 24 is rotatably supported on a shaft 23 which protrudes beneath the support plate 19, and engages with the pinion gear 22. Reference numeral 26' on the right side denotes a retaining ring to prevent the gear 24 from falling off.

A sprocket gear 24*a* is mounted integrally on the under surface of the gear 24. An endlessly formed timing belt 25 is engaged around the sprocket 24*a*.

The timing belt 25 is also engaged around a sprocket 28*b* on a tension pulley 28 rotatably supported on the side of the left side plate 2.

The tension pulley 28 is supported rotatably on a shaft 30 mounted protrudingly from a rotatable plate 29 supported rotatably on the base plate 3 in a position towards the left side plate 2 on the side where the pulse motor 10 is fixed.

An extended hole 29*b* is formed in a portion of the rotatable plate 29. A screw 37 passes through the extended hole 29*b* and is screwed into the base plate 3.

Accordingly, the rotatable plate 29 can rotate within the range of the long hole 29*b* by loosening the screw 37.

Above the tension pulley 28, an end of a switching plate 33 is rotatably supported on the shaft 30. A retaining ring 26 on the left side is attached to the shaft 30 via a spring washer 34, so that the switching plate 33 is prevented from falling off. A shaft 35 for rotatably supporting a switching gear 36 protrudes from the under surface of the switching plate 33.

The gear 36 integrally comprises three gears 36*a* –36*c* which have successively smaller diameters. A gear 32 is rotatably supported on a shaft 31 that is mounted protrudingly close to the rotatable plate 29. The gear 32 has in its central portion a shaft 32*a*. A top end of the shaft 32*a* is formed in a gear 32*l* engageable with an ink ribbon cassette 64 as described below. The gear 32 has a small-diameter gear 32*b* formed on its base portion, and has an internal gear 32*c* formed on its inside near the external circumference surface.

The switching gear 36 is engaged with the inside surface of the gear 32, so that the gear 36*b* and the gear 36*c* can engage respectively with the gear 32*b* and with the internal gear 32*c*. The gear 36*a* engages with a gear 28*a* disposed on the tension pulley 28.

In FIGS. 2 and 3, reference numerals 38 and 39 denote paper guide shafts that are disposed on the opposite side of the recording head 65 with respect to the platen 1. Both ends of these paper guide shafts 38 and 39 are fixed respectively by screws 18 and by retaining rings 47 to the left and right side plates 2.

Around the paper guide shaft 38, grooves (not shown) are formed corresponding to the paper width.

Paper guides 40*a* and 40*b* are slidably supported at both right and left ends of the paper guide shafts 38 and 39. Each of the paper guides 40*a* and 40*b* supports an end of a leaf spring 41 at the position corresponding to the paper guide shaft 38. The free end of the leaf spring 41 presses on a pin or steel ball (not shown) which is engaged in a hole formed through the paper guides 40*a* and 40*b* and can move up and down in the hole. As a result, the paper guides 40*a* and 40*b* are moved as needed along the paper guide shafts 38 and 39 and the pin or other member engages in the groove formed on the paper guide shaft 38 so that positioning is performed.

In this manner, by adopting an arrangement having grooves on the paper guide shaft 38 corresponding to the paper width, the paper guides 40*a* and 40*b* can be fixed simply by aligning with these grooves, thereby eliminating the need for positioning using gradations or other measures, and obviating operation of any locking lever, so that ease of operation is improved considerably.

Underneath the paper guide 40*b*, a paper detector 42 is mounted in a position between the recording head 65 and the pinch roller 44.

A paper pan 43 is disposed underneath the paper guide shafts 38 and 39 with its top edge extending underneath the platen 1. Through an opening 43*a* formed in the paper pan 43, the pinch roller 44 is pressed against the platen 1 by a spring (not shown).

A paper pressure plate 45 is supported on the base plate 3 by a supporting plate 46 in a manner such that the top edge presses the platen 1.

As shown in FIG. 3, the respective paper guides 40*a* and 40*b* have guide grooves 57*a* formed on their inside surfaces for inserting a cut sheet 56*a*, and have guide grooves 57*b* for inserting a fan-fold paper 56*b* underneath the grooves 57*a*.

In this manner, by adopting an arrangement in which the left and right paper guides 40*b* and 40*a* have the guide grooves 57*a* for the cut sheet 56*a* on their upper sides, and the guide grooves 57*b* for the fan-fold paper 56*b* on their under sides, ease of operation is improved when inserting frequently used cut sheets 56*a*.

A switching cam 49 for switching between colors on an ink ribbon 63 is installed at a home position side of a carriage 27 described below, that is close to the left-hand side in FIG. 2, on the base plate 3. As shown in FIG. 2, the switching cam 49 has a projection 49*a* and an inclined face 49*b* that has a maximum height at the left-hand side of the cam 49. An end of a spring 51 is engaged to the right side of a base 49*c* on which the cam 49 is fixed. The other end of the spring 51 coupled to the right edge side of a paper set lever 50.

The paper set lever 50 has a portion which extends to below the arm 13 on the side where the pulse motor 10 is fixed. This portion has an inclined face 50*b* which has a high left side. This inclined face 50*b* contacts with a protruding portion 13*a* formed underneath the arm 13.

On the right end side of the paper set lever 50, a projection 50*a* protrudes towards the front. To the front of the cam 49, a slit plate 52 is disposed stretched between support plates 53 and 53 extending from the base plate 3.

The slit plate 52 has slits which are detected by a photo-interrupter (not shown) fixed to the lower portion of the carriage 27, thereby controlling the recording position.

Reference numeral 54 denotes a knob for manual feeding of the platen 1 which is attached to the right end of the platen shaft 1*a* through a boss 4'.

The recording head 65 is mounted on the upper surface of the carriage 27 that is slidably supported on guide shafts 11 and 12.

In the present embodiment, the recording head 65 is arranged as a wire-dot head. Furthermore, two ribbon guide shafts 58 and 58 are protruded from an end portion of the carriage 27 on the side of the platen 1. A slide holder 59 is slidably engaged with the ribbon guide shafts 58 so that it can move up and down along the ribbon guide shafts 58.

A ribbon guide 60 is fitted to the slide holder 59. A ribbon mask 61 for preventing soiling of the recording paper 56 by the ribbon 63 is attached to this ribbon guide 60. The ink ribbon 63 described below passes through the inside of this ribbon mask 61.

This slide holder 59 is formed into a hollow shape, and three cams 59*a*–59*c* are protruded successively from the top from the inside plane of one side wall 59*x* thereof, that is, in FIG. 2 from the inside plane of a side wall 59*x* on the right side. Underneath the slide holder 59, a lock lever 62 is rotatably pivoted in its middle portion by a shaft 62*b* mounted on the carriage 27.

Figure 9C:
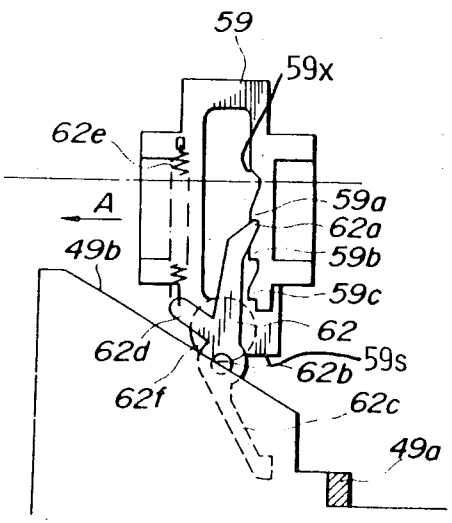
FIGS. 9A to 9C are side views explaining the operation of a lock lever and slide holder for driving a ribbon color changer and a paper set mechanism.
Figure 9A:
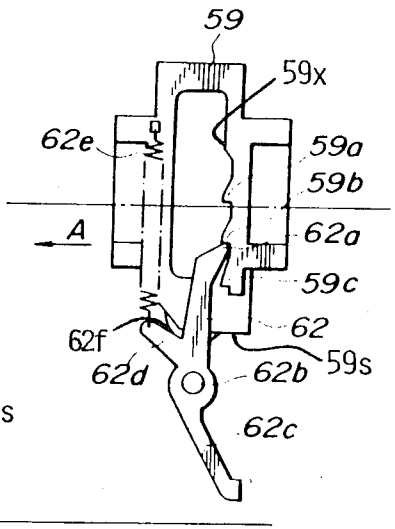
Figure 9B:
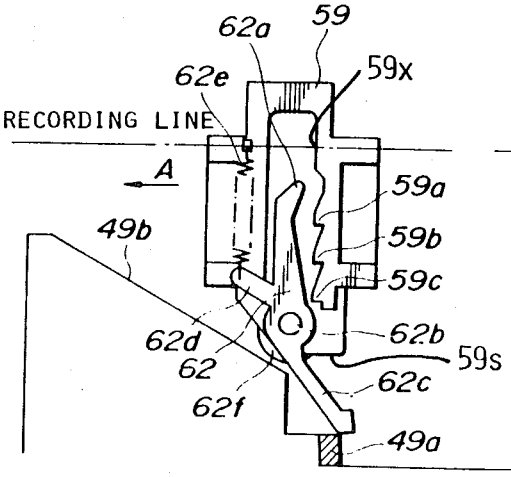

As shown in FIGS. 9A to 9C described below, on the top end of the lock lever 62 is disposed a claw 62*a* that can engage with the cams 59*a* to 59*c*, and on the bottom end of the lock lever 62 is disposed a projection 62*c* that can engage with the projection 49*a*.

A projection 62*d* is protruded from the middle portion of the lock lever 62 in the direction of arrow A. A spring 62*e* is stretched between this projection 62*d* and the top edge portion of the slide holder 59.

Accordingly, the lock lever 62 applies a rotating force in a clockwise direction around the center of a shaft 62*b* in FIGS. 9A to 9C.

When the claw 62*a* is not engaged with any of the cams 59*a* to 59*c*, and the slide holder 59 is in its lowest position, a bottom lower edge 59*s* can engage with a projection 50 on the lever 50.

Figure 6:
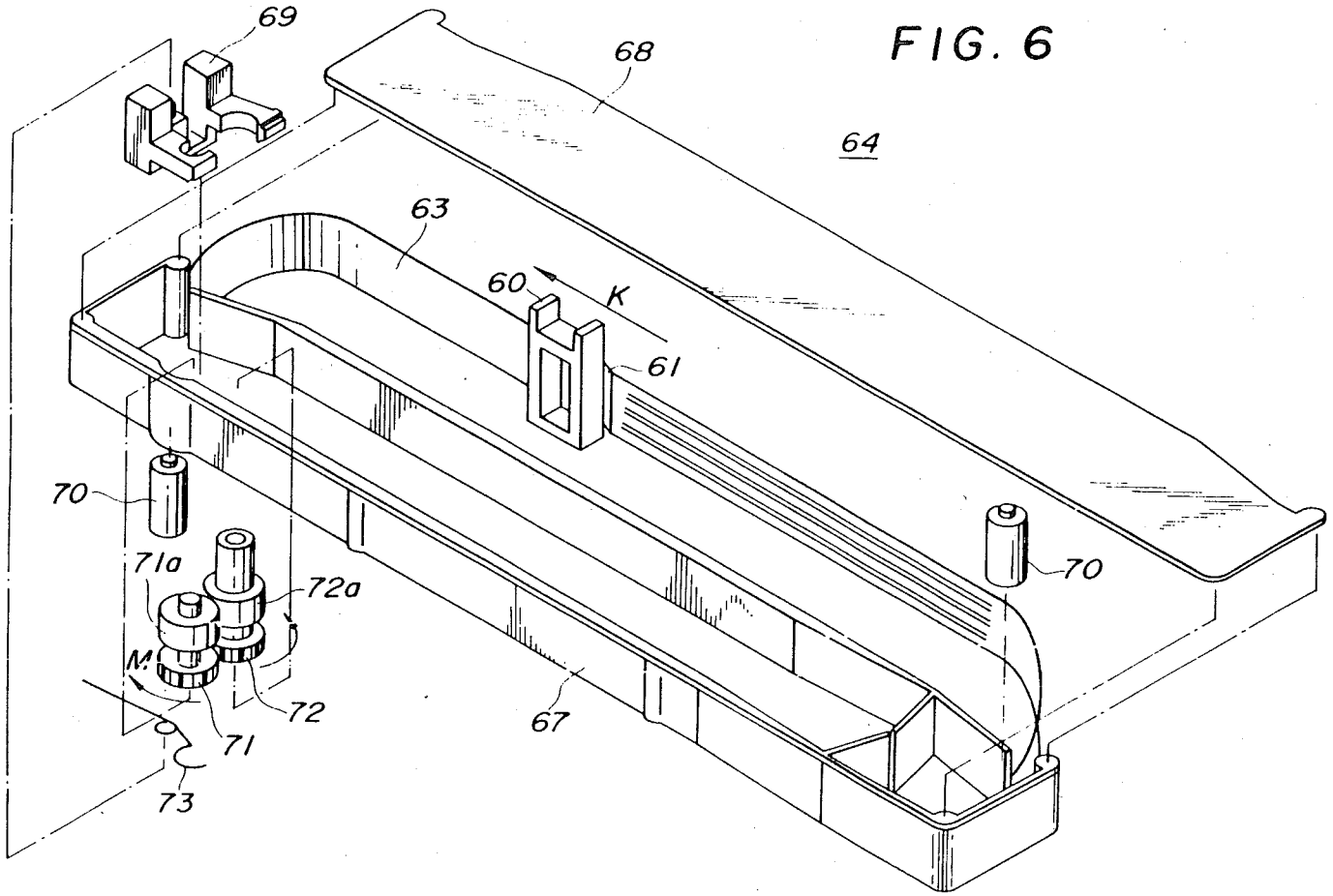
FIG. 6 is a perspective view showing an embodiment of an ink ribbon cassette holding an ink ribbon in FIG. 2.

FIG. 6 is an example of an arrangement of an ink ribbon cassette 64.

This ink ribbon cassette 64 comprises a cassette body 67 and a cover 68. Guide rollers 70 are rotatably supported at both ends of the cassette body 67.

A ribbon separator 69 is disposed at an end of the cassette body 67, near the left side in FIG. 6. A ribbon feed gear 71 and a follower gear 72 are rotatably supported on this ribbon separator 69.

The two gears 71 and 72 engage with each other. Rollers 71*a* and 72*a* that are mounted integrally on the top of the gears 71 and 72 make contact. Reference numeral 73 denotes a spring that presses the roller 72*a* of the follower gear 72 on to the roller 71*a*. The ribbon feed gear 71 is arranged so that it engages the gear 32*l* formed on the shaft 32*a* of the ribbon gear 32. Therefore, when the gear 71 engaged with the gear 32*l* is rotated in the direction N, the ink ribbon 63 is transported in the direction K.

As shown in FIGS. 10A to 10D, the ink ribbon 63 has a cleaning band 63*a* and color zones comprising a yellow zone 63*b*, a cyan zone 63*c* and a magenta zone 63*d* successively from the top in the traversal direction of the ribbon 63. Reference numeral 66 in Figs. 10A to 10D denotes a wire mounted on the recording head 65.

In the present embodiment, the recording head 65 has four pins (wires) 66 disposed for every other dot in a vertical direction. The pins 66 are given Nos. 1–4 in order from the top (see FIG. 11A). When recording, the recording paper 56*a* or 56*b* is moved through ½pitch of the pin 66 distance for one dot), so that recording is performed of 8 dots in an up-and-down direction. To perform black recording, the three colors yellow, cyan and magenta are overprinted.

An explanation will be made of the operation of the printer according to the present invention.

First, an explanation will be made of the operation for setting a recording paper such as the paper 56*a* or 56*b* using FIGS. 7, 8A to 8E and 9A to 9C.

FIGS. 7 and 8A to 8E explain the operation for automatic setting of the recording paper 56. The timing points TA to TE in FIG. 7 correspond to FIGS. 8A to 8E respectively.

The paper guides 40*a* and 40*b* are moved and set to match the width of the recording paper 56 being used. In this condition, when cut-sheet paper 56*a* is being used, it is inserted into the guide grooves 57*a*, and when fan-fold paper 56*b* is being used, it is inserted into the guide grooves 57*b*.

Figure 8A:
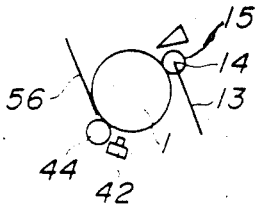
FIGS. 8A to 8E are side views explaining the successive operations when setting recording paper by the printer shown in FIG. 2.

Whichever type of paper is being used, after the recording paper 56 has been inserted, it stops against the contact portions of the pinch rollers 44 and the platen 1. This situation is shown in FIG. 8A.

In this situation, as is clear from FIG. 3, the paper detector 42 is below the pinch roller 44 so that the paper detector 42 senses no paper as shown by the portion indicated by arrow TA in FIG. 7. At this time, as explained below in regard to FIGS. 16A and 16B, the printer is in the off-line condition, and automatic setting is possible.

In this condition, the paper hold shaft 14 is turned to the platen 1 side, and the paper hold roller 15 is in contact with the platen 1.

When a paper feed switch 342 (see FIG. 15) is pressed after the recording paper 56 has been set, the motor 21 is driven and rotates the pinion gear 22 in the direction of an arrow C in FIG. 2. This rotation is transmitted to the gear 24 and the timing belt 25, so that the carriage 27 advances in the direction of an arrow A in FIG. 2.

Figure 7:
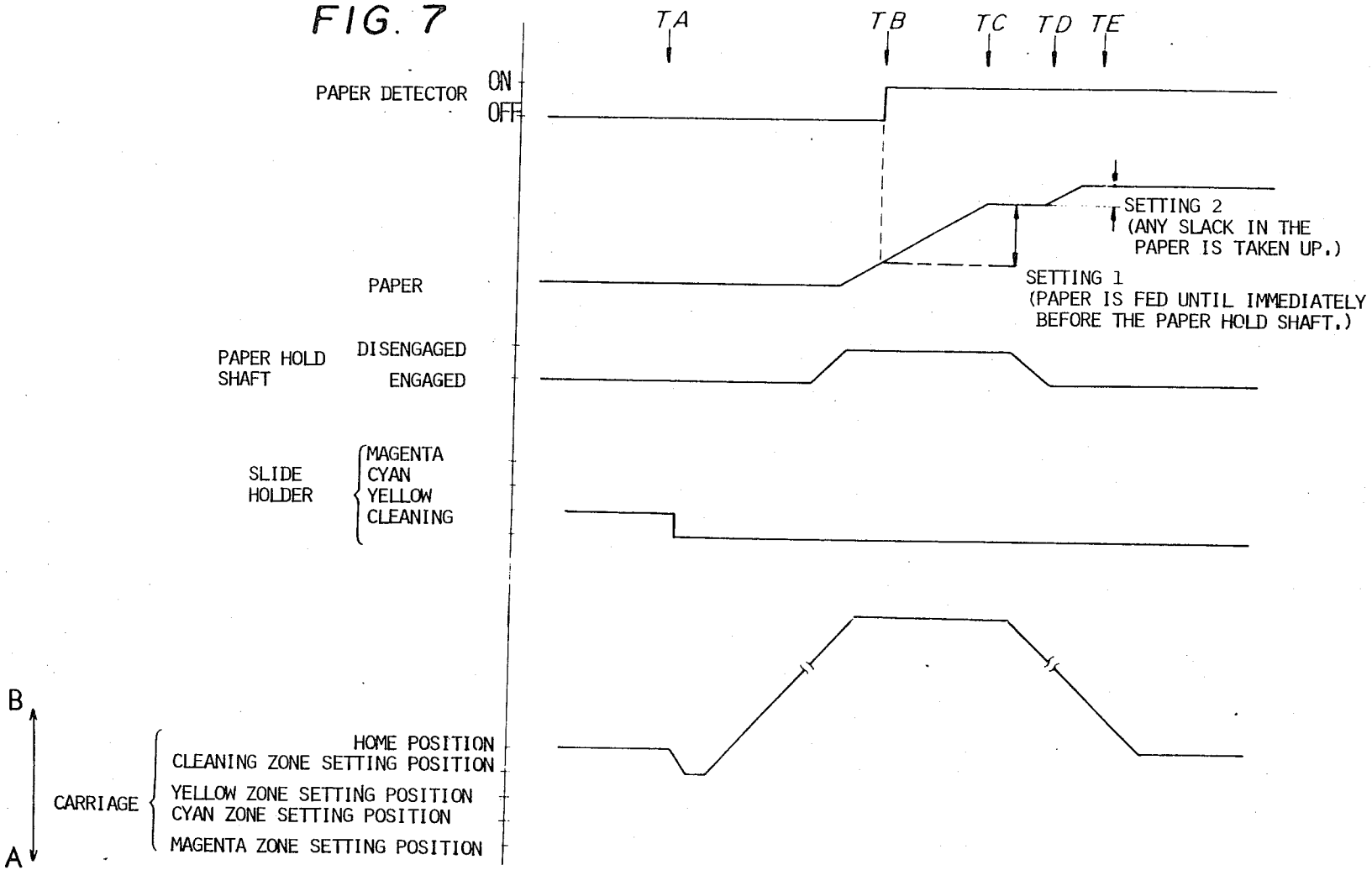
FIG. 7 is a timing chart illustrating setting of recording paper by the printer shown in FIG. 2.

At the time of the first operation for paper setting, the carriage 27 exceeds the home position that is the printing start position, and moves in the direction of the arrow A as shown in FIGS. 2 and 7.

Consequently, as shown in FIG. 9A, the lock lever 62 advances with the cam 59*b* and the claw 62*a* engaged in the condition as for the previous printing, but as soon as the projection 62*c* of the lock lever 62 contacts with the projection 49*a*, and as shown in FIG. 9B, the lock lever 62 is turned in a counterclockwise direction with respect to the drawing against the spring 62*e*.

As a result, the claw 62*a* and the cam 59*b* disengage, and the slide holder 59 receives the tensile force of the spring 62*e* and falls to its lowest position with the ribbon guide 60 and the ribbon mask 61.

That is, for instance, the situation shown in FIG. 9A in which the yellow zone 63*b* of the ink ribbon 63 is opposite the wire 66, changes to a situation shown in FIG. 9B in which the cleaning zone 63*a* is opposite the wire 66.

At this time, the motor 21 reverses to rotate in the direction shown by an arrow D in FIG. 2, and the carriage 27 returns in the direction shown by an arrow B.

Consequently, the bottom edge 59*s* of the slide holder 59 contacts with the projection 50*a* of the paper set lever 50, and the paper set lever 50 is moved in the direction of the arrow B against the spring 51.

At this time, the inclined face 50*b* makes contact with the projection 13*a* so that the projection 13*a* mounts the inclined face 50*b* as the inclined face 50*b* moves in the direction of the arrow B, and the arm 13 rotates in the direction (indicated by an arrow J in FIG. 2) away from the platen 1.

Figure 8B:
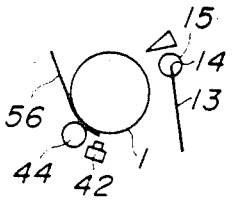

As a result, the paper hold shaft 14 moves away from the platen 1 together with the paper hold roller 15 as shown in FIG. 8B.

At this time, the carriage 27 is stopped and the paper feed pulse motor 10 rotates in the direction of an arrow E, so that the platen 1 is rotated in the direction of an arrow G by the pinion gear 9 and the gears 6*a* and 6*b*. Then, the pinch roller 44 which is contacting the platen 1 rotates in the opposite direction so that the recording paper 56 which is held between them is fed.

As a result, the top edge of the recording paper 56 passes the paper detector 42 which senses the paper 56 as shown in FIG. 7.

Figure 8C:
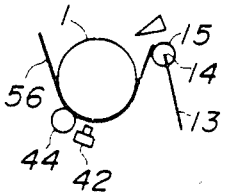

From this time, a uniform stepped pulse signal is supplied to the pulse motor 10, and by rotating the platen 1 in the direction of the arrow G, the recording paper 56 is fed as shown in FIG. 8C.

These operations are the procedure for feeding the recording paper 56 up until immediately before the paper hold shaft 14 as shown in "Setting 1" in FIG. 7.

At the same time as the paper feed, the motor 21 is reversed in the direction of the arrow C in FIG. 2, so that the carriage 27 is moved in the direction of the arrow A.

Figure 8D:
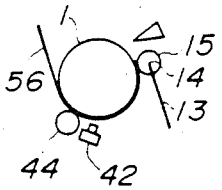

As a result, the paper set lever 50 is pulled in the direction of the arrow A in FIG. 2 by the spring 51, and the arm 13 also rotates in the direction of an arrow I in FIG. 2 to return to its original position as shown in FIG. 8D, and the paper hold roller 15 presses down on the platen 1 via the recording paper 56.

Figure 8E:
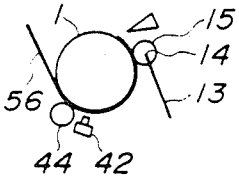

Next, as shown in "Setting 2" in FIG. 7, the recording paper 56 is fed through a predetermined distance to take up any slack in the paper 56. FIG. 8E shows this condition.

This completes the automatic setting of the recording paper 56.

Switching of color and cleaning of the ends of the wires 66 when recording is performed as shown in FIGS. 10A to 10D and 11A and 11B.

When the motor 21 is rotated in the direction of the arrow C in FIG. 2 (the reverse direction), the carriage 27 is moved further past the home position in the direction of the arrow A by the timing belt 25.

Figure 10A:
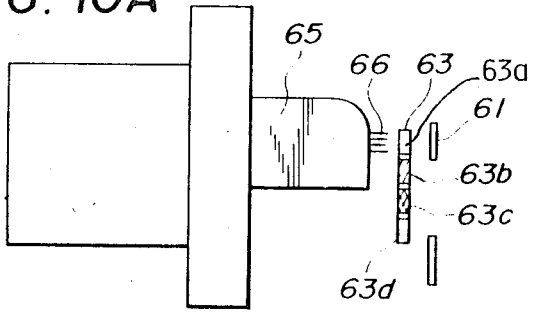
FIGS. 10A to 10D are side views explaining changes in position of an ink ribbon with respect to a recording head.

As a result, the projection 62*c* on the lock lever 62 is in contact with the projection 49*a* as described above, and the claw 62*a* disengages from whichever of the cams 59*a* to 59*c*, so that the slide holder 59 falls to its lowest position together with the ribbon guide 60, the ribbon mask 61 and the ink ribbon 63. Consequently, the cleaning band or zone 63*a* is positioned opposite the wires 66 as shown in FIG. 10A.

In this condition, when current is applied to a solenoid (not shown) mounted on the recording head 65, the wires 66 jump forward and contact the cleaning band 63*a* so that their tips are cleaned.

After cleaning is finished, the motor 21 is rotated in the direction of the arrow C and the carriage 27 is moved further in the direction of the arrow A so that a roller 62*f* mounted on the bottom of the slide holder 59 begins to move up the inclined face 49*b* as shown in FIG. 9B.

When the carriage 27 has moved a fixed amount, the slide holder 59 moves upwards a fixed amount corresponding to this until the claw 62*a* on the lock lever 62 engages with the cam 59*a* in the uppermost position. FIG. 9C shows this situation.

Figure 10B:
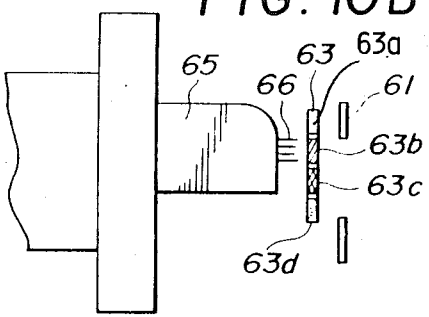
Figure 10C:
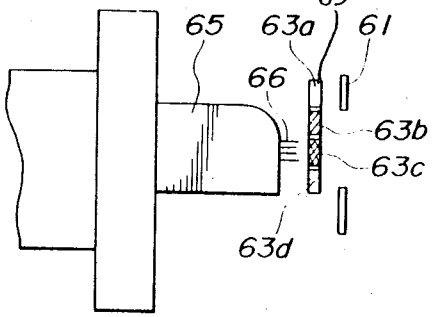
Figure 10D:
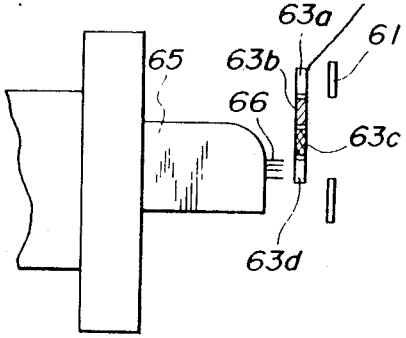

At this time, the yellow zone 63*b* of the ink ribbon 63 is positioned opposite the wires 66 as shown FIG. 10B.

When the motor 21 is rotated in the direction of the arrow D (the forward direction) at this time, the carriage 27 begins to move in the direction of the arrow B.

Figure 11B:
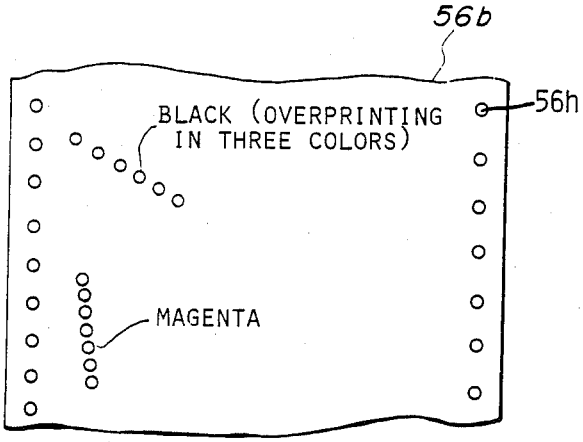
Figs. 11A and 11B are respectively a timing chart and a recording sample showing an example of the movement during recording by the printer shown in FIG. 2.
Figure 11A:
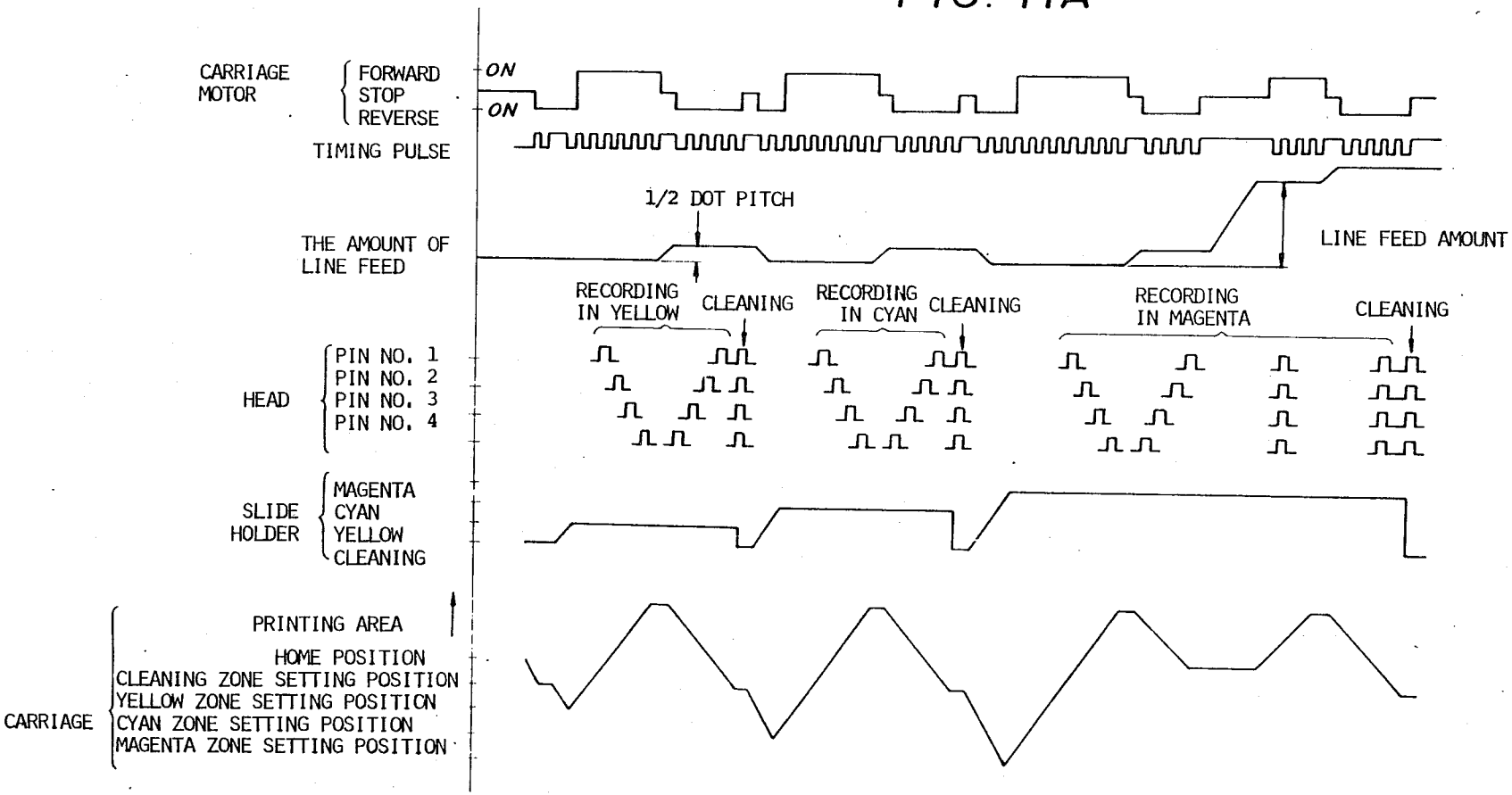

Timing pulse signals as shown in the second section from the top of FIG. 11A are generated by the detector comprising the photo-interruptor mounted underneath the carriage 27 and the slits of the slit plate 52.

In this situation, when current is applied to a solenoid (not shown) synchronously with these timing pulse signals, recording is performed of a character font, for instance of four alternate dots in the vertical direction of an oblique line as shown in FIGS. 11A and 11B, in accordance with a recording signal.

When current is supplied to the pulse motor 10 so that it is rotated in the direction of the arrow E, the platen 1 is rotated in the direction of the arrow G by the gears 9, 6*a* and 6*b*, and the recording paper 56*x* is fed by the frictional force between the pinch roller 15 and the platen 1.

That is, a gear 17 fixed on an end of the platen shaft 1*a* engages with the paper hold gear 16 fixed on the shaft 14, so that the recording paper 56 is fed.

This operation feeds the recording paper 56 by a one-half pitch of the wires 66.

In the present embodiment, the gear ratio between the gears 17 and 16 is set so that the speed of rotation of the paper hold roller 15 greatly exceeds the speed of rotation of the circumference of the platen 1. Accordingly, the fixed tensile force generated by the paper hold roller 15 acts to stretch the recording paper 56, thereby eliminating the "tapping" sound generated by vibration of the paper 56 when recording.

Next, when a pulse signal is supplied to rotate the motor 21 in the direction of the arrow C, the timing belt 25 begins to move the carriage 27 once more in the direction of the arrow A, and dots are recorded in the intermediate positions in a vertical direction of the alternate dots in a vertical direction already recorded during the return operation, thereby completing recording of the object character in yellow.

Next, the carriage 27 is moved in the direction of the arrow A. The roller 62*f* is moved further along the inclined face 49*b* from the condition shown in FIG. 9C, and the cyan zone 63*c* of the ink ribbon 63 rises to a position opposite the wires 66. The same type of operation as that described above is performed to overprint a cyan color on top of the character recorded in yellow.

Next, the carriage 27 is moved further in the direction of the arrow A, and the magenta zone 63*d* of the ink ribbon 63 is set so that it is positioned opposite the wires 66. Then, when a magenta color is overprinted in the same manner as described above, the colors yellow, cyan and magenta are mixed so that recording of an oblique line in black as shown in FIG. 11B is completed.

Each recording is performed in a different color, the carriage 27 is moved in the direction of the arrow B, the slide holder 59 is lowered, and cleaning is performed by positioning the cleaning band 63*a* opposite the wires 66.

Next, when it is desired, as shown in FIG. 11B, to record a single character of an inclined line on one line, to perform a line feed and to record on the next line in magenta only, the recording paper 56 can be fed for a single line and recording is begun without performing cleaning.

During cleaning, the ribbon mask 61 comes between the cleaning zone 63*a* and the platen 1 as shown in FIG. 10A so that the recording paper 56 does not make contact with the cleaning band 63*a* and the wires 66.

In the example shown in FIGS. 11A and 11B, recording of only a single character on one line was performed in order to simplify the explanation. In reality, after recording of a whole line in the same color, the other colors are all overprinted for recording in black.

Of course in the case of mixed colors, overprinting need only be performed selectively on the object character.

The above operations permit recording of yellow, cyan and magenta, of green, blue, red and black (by mixing three colors) which are mixes of the yellow, cyan and magenta and of white (the color of the recording paper), for a total of eight colors.

On the ink ribbon 63 having the three color zones 63*b*–63*d* and a the cleaning zone 63*a* three colors must be mixed to record black. Consequently, for frequent recording in black alone, a black ink ribbon cassette can be prepared for use as the recording cassette when recording as described above, or by preparing a ribbon cassette having a black zone as well and an arrangement that can be positioned at that black zone as well, so that recording in black is performed, thereby preventing any lowering in the recording speed.

Next, an explanation will be made of the operation of the ink ribbon 63 with reference to FIG. 6.

When the ink ribbon cassette 64 is mounted in the predetermined position, and the ribbon feed gear 71 is rotated in the direction of the arrow M, the ink ribbon 63 that is held between the roller 71*a* of the gear 71 and the roller 72*a* of the follower gear 72 that is being pressed on the roller 71*a* by the spring 73 is drawn into the cassette body 67, at the same time as the ink ribbon 63 is drawn out from the other end. When the printing color is changed, the slide holder 59, the ribbon guide 60, the ribbon mask 61 and the ink ribbon 63 move up and down at the same time. At that time, the cassette body 67 does not move at all, and only the ribbon 63 which is outside the cassette body 67 moves up and down. Because the ribbon guide 60 and the ribbon mask 61 on the ink ribbon 63 are integrated, there is no need for complex operations such as inserting the ribbon 63 between the ribbon mask 61 and the nose of the recording head 65 with a pencil or similar implement when changing cassettes 64. Cassettes 64 can be changed with the simple operation of inserting the ribbon guide 60 into the slide holder 59.

During ribbon feeding, the timing belt 25 is driven by the motor 21. The other end of the timing belt 25 drives the tension pulley 28. Furthermore, the tension pulley 28 is supported by the shaft 30 so that the tension on the timing belt 25 can be changed by rotating the rotatable plate 29.

The shaft 30 rotates the switching plate 33 in the direction of rotation of the tension pulley 28 by its friction. Then, the switching gear 36 engages with the gear 32.

When, for instance, the tension pulley 28 is driven in the direction of the arrow N, the switching plate 33 rotates in the direction of the arrow N due to its friction. Then, the gear portion 36*b* on the switching gear 36 engages with the gear portion 32*b*, and the rotation of the tension pulley 28 in the direction N is transmitted to the ribbon gear 32 as rotation in the direction N.

When the tension pulley 28 is driven in the direction O, the switching plate 33 rotates in the direction O and the gear portion 36*c* of the switching gear 36 engages with the gear portion 32*c* of the ribbon gear 32 so that the rotation of the tension pulley 28 in the direction O is transmitted to the ribbon gear 32 as rotation in the direction N. That is, the direction of rotation of the ribbon gear 32 is always in the direction N, regardless of the direction of rotation of the tension pulley 28.

The gear 32*l* of the ribbon gear 32 engages with the ribbon feed gear 71 of the above-mentioned cassette 64 and feeds the ribbon 63.

An explanation will be made of another embodiment of a paper feed arrangement for setting and feeding recording paper.

Figure 12:
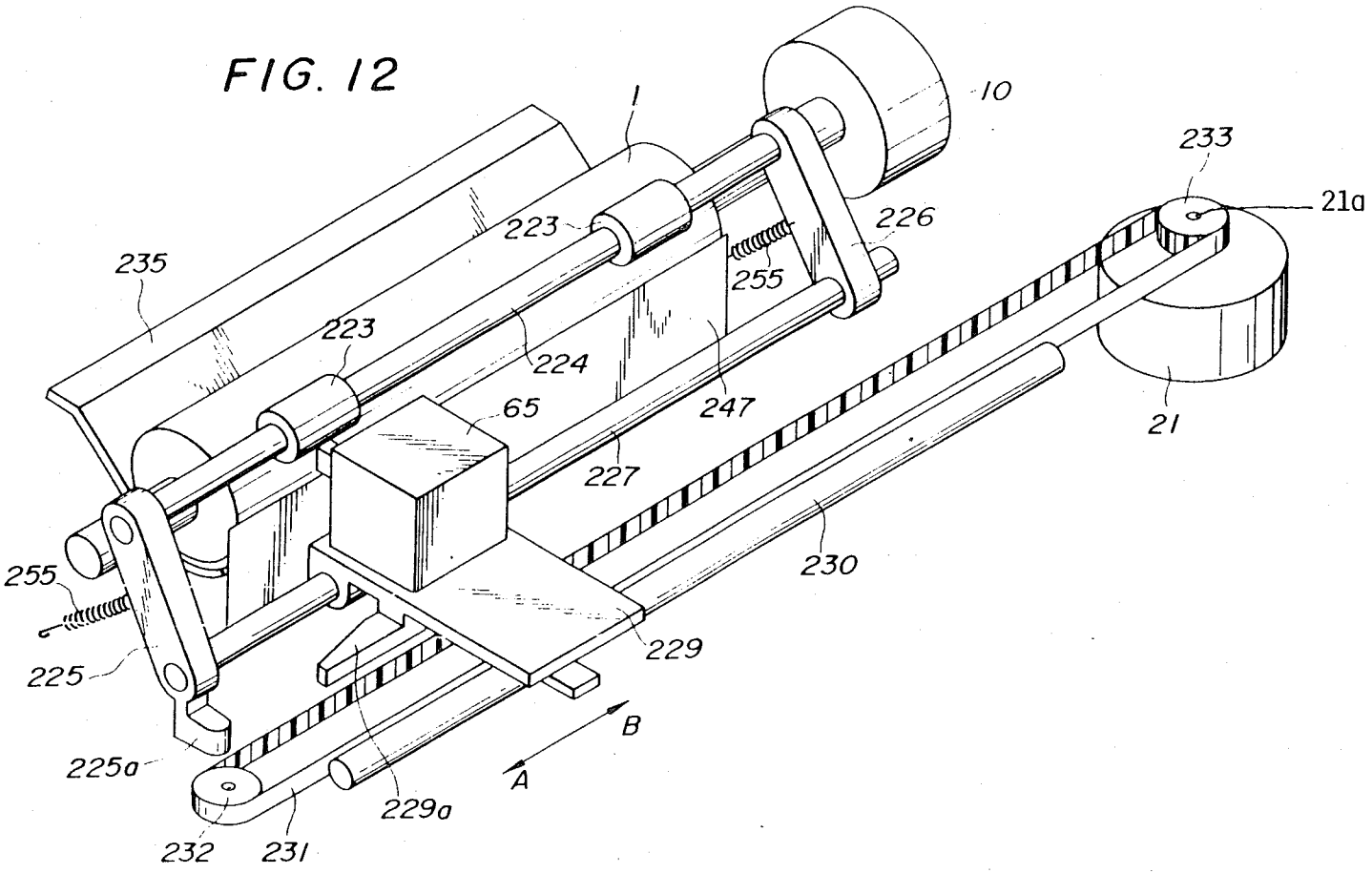
FIGS. 12 and 13 are respectively perspective view and side view showing another embodiment of a printer according to the present invention.
Figure 13:
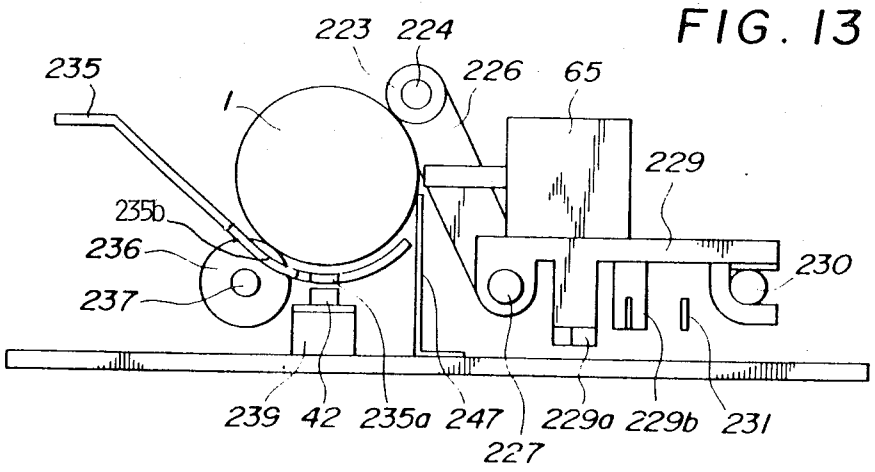

FIGS. 12 and 13 show a general arrangement of a printer according to the present invention, focussing on a paper feed arrangement for performing setting and feeding of recording paper.

In the drawings, the platen 1 is rotatably supported between side plates 2 not shown in FIG. 12 (see FIG. 2), and is coupled to a paper feeding pulse motor 10 at one end.

Paper hold rollers 223 are in contact with the platen 1. The paper hold rollers 223 are rotatably and slidably supported on a shaft 224.

Top ends of arms 225 and 226 are linked to both ends of the shaft 224. Bottom ends of the arms 225 and 226 are linked to both of a carriage guide shaft 227. A projection 225*a* protrudes from the lower end portion of the arm 225.

Figure 14A:
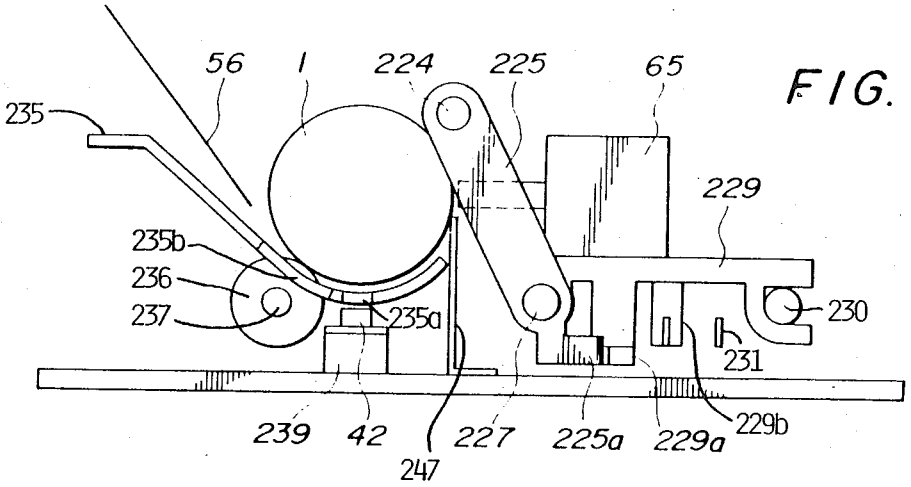
FIGS. 14A to 14C are side views showing the successive operations when setting recording paper in the printer shown in FIGS. 12 and 13.
Figure 14B:
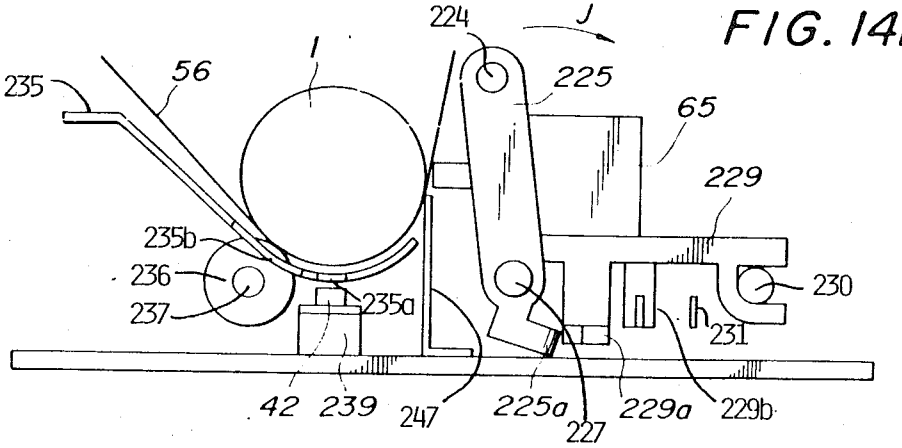
Figure 14C:
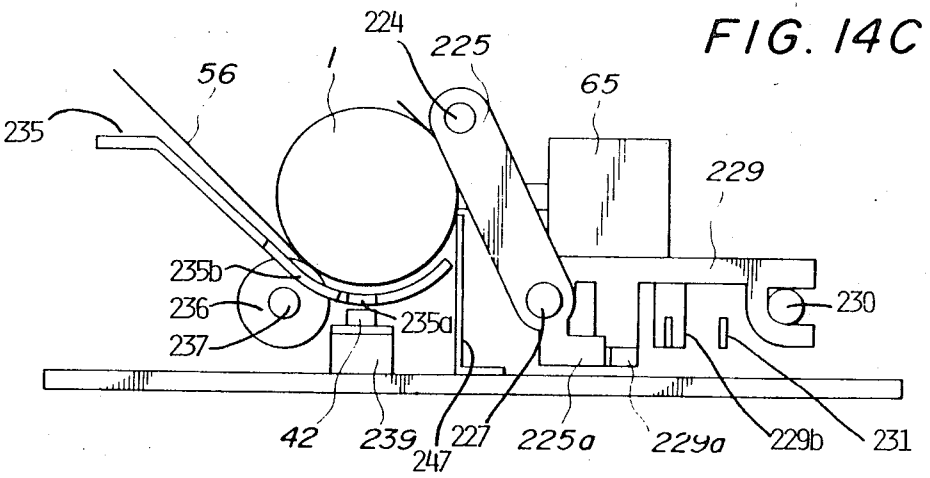

A recording head 65 is mounted on a carriage 229 supported on the carriage guide shaft 227 and to another carriage guide shaft 230 which is disposed parallel to the carriage guide shaft 227. A cam 229*a* protrudes from an edge of the carriage 229 on the side of the arm 225. When the carriage 229 is positioned to the left (in the direction A) of its home position, the cam 229*a* engage with the projection 225*a* protruding from the lower end portion of the arm 225, and rotates the arms 225 and 226 in a clockwise direction with respect to FIG. 12. That is, at this time paper setting as shown in FIGS. 14A to 14C is possible.

Springs 255 apply a rotating force to the left and right arms 225 and 226 in a direction such that the paper hold rollers 223 approach the platen 1.

Reference numeral 231 denotes a timing belt disposed between a driven pulley 232 and a drive pulley 233 fixed to an output shaft 21*a* of the pulse motor 21.

The timing belt 231 is linked to the carriage 229 through a clamp 229*b* protuding from the lower surface of the carriage 229, so that the carriage 229 can move in a direction A and in a direction B following the travel of the timing belt 231.

Reference numeral 235 denotes a paper pan that is mounted between side plates similar to the side plates 2 in FIG. 2 with a specified gap to the lower surface of the platen 1 so as to guide the recording paper 56.

A pinch roller 236 is rotatably supported by a shaft 237 underneath the paper pan 235 and in a position towards the side on which the recording paper 56 is inserted.

The shaft 237 is pulled towards the platen 1 by a spring not shown. The pinch roller 236 enters through an opening 235*b* formed in the paper pan 235 so that it can make contact with the platen 1.

In the present embodiment, a paper detector 42 is disposed underneath the platen 1 and in a position corresponding to an opening 235*a* formed in the paper pan 235, and is supported by a support 239. The opening 235*a* is positioned corresponding to feed holes 56*h* of fan-fold paper 56, so that when the fan-fold paper 56*b* is used the detector 42 can sensen feed holes 56*h* (see FIG. 11B).

The paper detector 42 has, for instance, a reflecting-type photo-interruptor similar to the example shown in FIG. 2 and can sense the top and bottom ends of recording paper 56, and the presence or absence of the recording paper 56. When using the fan-fold paper 56*b* the detector 42 can count the number of feed holes 56*h* in the recording paper 56*b* in accordance with the on and off of the sense signal.

Reference numeral 247 denotes a paper hold plate for holding recording paper 56.

Next, an explanation will be made of a sequence for realizing a paper setting operation on a printer having a paper feed mechanism as shown in FIG. 2 or FIG. 12.

Figure 15:
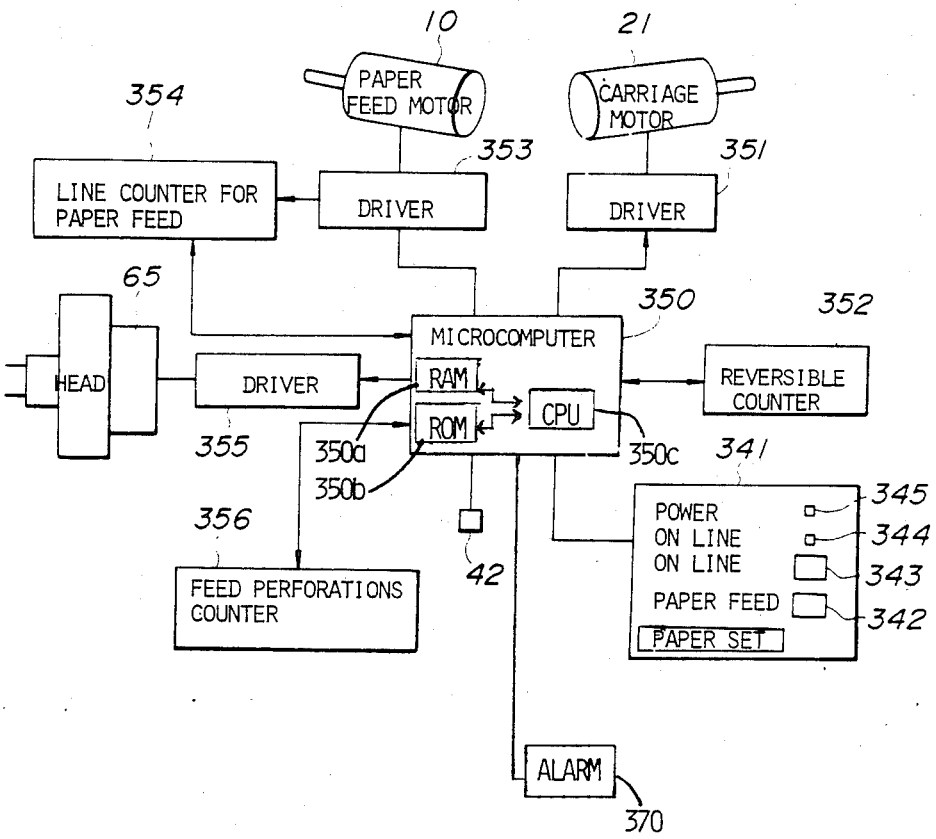
FIG. 15 is a block diagram showing an embodiment of an electrical arrangement in a printer shown in FIG. 2 or FIG. 12 according to the present invention.

FIG. 15 shows an embodiment of a electrical arrangement for the printer shown in FIG. 2 or FIG. 12.

Figure 16A:
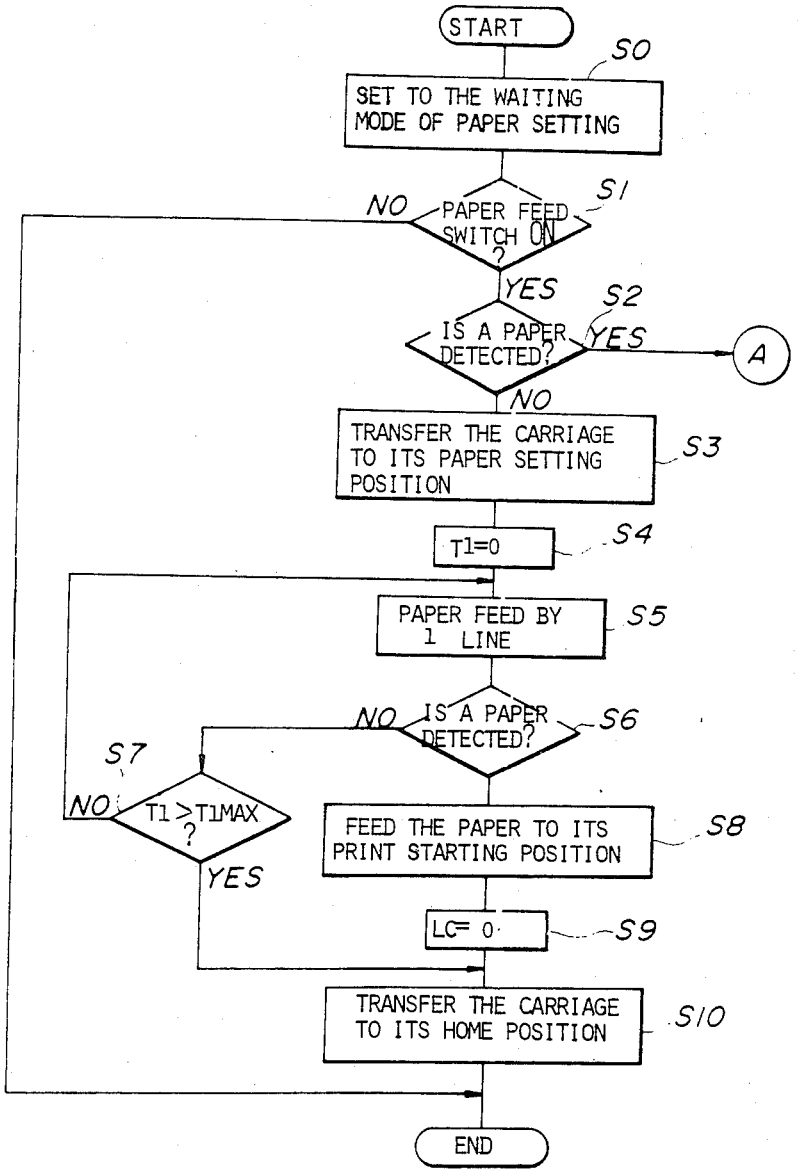
FIGS. 16A and 16B are flowcharts showing an example of a procedure for setting recording paper by the printer shown in FIG. 15.
Figure 16B:
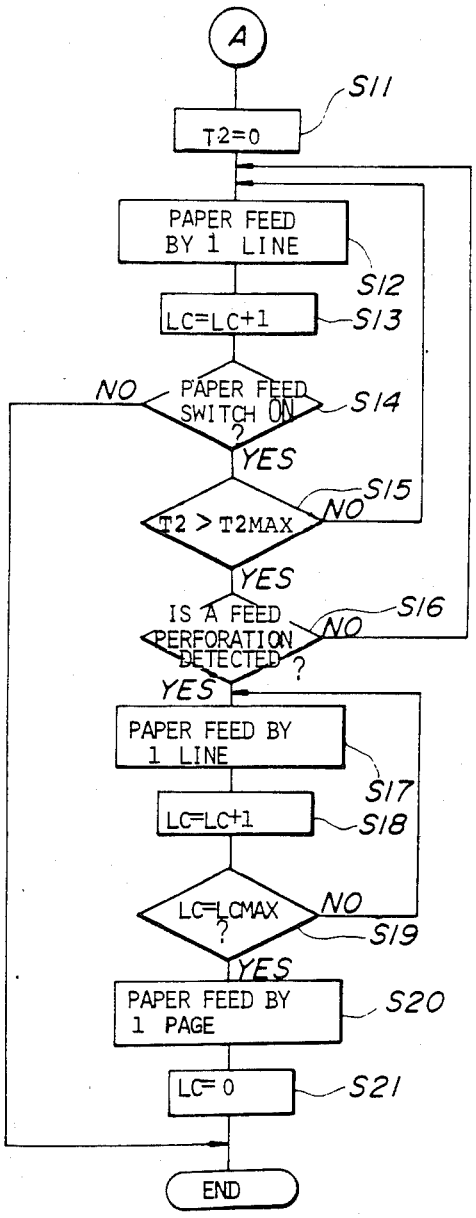

Reference numeral 350 denotes a calculation and recording control section performing overall control of the present recording device, and can be a microcomputer for instance. The microcomputer 350 has a writable random access memory (RAM) 350*a*, an unwritable read only memor (ROM) 350*b*, and a central processing unit (CPU) 350*c* for controlling the various sections according to the contents of memories 350*a* and 350*b*. Recording and other data are stored in the RAM 350*a*, and the recording control sequences, particularly the processing procedure in FIGS. 16A and 16B are stored in the ROM 350*b*. Reference numeral 351 denotes a carriage motor driver that drives the carriage motor 21 according to commands from the microcomputer 350, thereby driving the carriage 229 back and forth. Reference numeral 352 denotes a reversible counter for sensing the position of the carriage 229, that counts the number of pulses equal to those applied to the carriage motor 21. The counter 352 adds positive pulses that move the carriage 229 in the forward direction, and subtracts the negative pulses that move the carriage 229 in the reverse direction, thereby continually sensing the position of the carriage 229. Reference numeral 353 denotes a paper feed motor driver that drives the paper feed step motor 10 according to commands from the microcomputer 350, and rotates the platen 1 to feed the paper 56 by a predetermined amount.

At this time, the number of pulses applied to the step motor 10 is counted by a paper feed line counter (LC) 354 so as to sense the number of lines of paper feed being performed currently. Reference numeral 355 denotes a head driver that drives a recording head 65 according to commands from the microcomputer 350 to perform recording on the paper 56.

Reference numeral 341 denotes an operating panel that is disposed on a portion of the printer.

On the panel 341 are disposed a paper feed switch 342, on on-line switch 343 to command execution and stopping of data transfer, a lamp 344 to display an on-line condition and a power supply lamp 345.

The paper feed switch 342 performs a paper feed by one line, a continuous feed and a paper setting. The functions of the paper feed switch 342 are switched according to the output from the paper detector 42. When a fan-fold paper **56*b* is being used, the paper feed switch 342** also performs the function of top of form feed.

Reference numeral 356 denotes a feed hole counter to count the feed holes detected by the paper detector 42 when using fan-fold **56*b*. The feed hole counter 356 is reset to "0" each time it counts a predetermined number of feed holes punched per unit page (the size of the minimum unit that can be torn along perforations) of the fan-fold paper 56*b*. The contents of the paper feed line count 354 are modified according to the output from the feed hole counter 356**.

FIGS. 16A and 16B shown the processing procedure for setting recording paper 56 by the printer shown in FIG. 15 according to the present invention. The processing procedure is loaded into the ROM **350*b* in the microcomputer 350**.

First, in step S0 when the power supply is turned on, and in cases such as when the recording paper 56 is not set or the recording paper 56 runs out during recording, the paper detector 42 senses this and the microcomputer 350 sets the device into the off-line status. At this time, an alarm is generated such as from a buzzer 370, for instance, as a paper out alarm. At the same time, the online lamp 344 flashes. This mode is the waiting mode of automatic setting of the recording paper 56. That is, in the case of FIG. 2, this corresponds to the condition shown in FIG. 8A and in the case of FIG. 12, this corresponds to the condition shown in FIG. 14A.

When the paper feed switch 342 is pressed, the pressing of switch 342 is verified at step S1, and it is judged at step S2 whether or not paper 56 is sensed. In the present case, no paper 56 is sensed, so that at step S3, the carriage drive pulse motor 21 is driven, and the carriage 229 is moved to the paper set position.

That is, in the case of the printer in FIG. 2, the carriage 27 is moved beyond the home position in the direction A and positioned in the position in FIG. 9B. After the slide holder 59 is set in its lowest position, the carriage 27 is moved in the direction B.

As a result, the bottom edge **59*s* (see FIGS. 9A–9C) of the slide holder 59 engages with the projection 50*a* (see FIG. 2) on the paper set lever 50. In response to this engagement, the projection 13*a* of the arm 13 mounts on the inclined face 50*b* so that the paper hold shaft 14 mounted between the arms 13 and 13 moves away from the platen 1 together with the paper hold roller 15 (FIG. 8**B).

In the case of the printer in FIG. 12, the carriage 229 is moved further beyond the home position in the direction of the arrow A in FIG. 12 up to the outer side paper set position.

As a result, the cam **229*a* contacts the projection 225*a* on the lower end portion of the arm 225 and pushes this so that, as shown in FIG. 14B, the arm 225 is rotated in the clockwise direction as indicated by the arrow J in FIG. 14**B.

At this time, the other arm 226 is also rotated in the same direction by the shaft 224.

Then, the paper hold roller 223 moves away from the platen 1.

At step S4, a timer T1 built into the CPU **350*c*** is set and begins counting so as to prevent unnecessary paper feed operation.

At step S5, the platen 1 is rotated for the amount of one line in the paper feed direction by the pulse motor 10. Next, at step S6 is judged whether or not the paper 56 has reached the position of the detector 42. Then, at step S7 the value of the timer T1 and a predetermined value T1max (for instance, 15 seconds) are compared. When the value of the timer T1 is greater than T1max, the procedure advances directly to step S10, and the carriage 229 is moved to the home position. By stopping the paper feed operation when no paper 56 sensed even after the predetermined time has passed, and it is judged that no paper 56 has been inserted, excessive unnecessary operations are prevented.

On the printer shown in FIG. 2, when the operator inserts recording paper 56 within the predetermined time, the recording paper 56 is held between the platen 1 and the pinch roller 44, and feeding is begun.

On the printer shown in FIG. 12 too, when the operator inserts the recording paper 56 between the platen 1 and the paper pan 235, the platen 1 and the pinch roller 236 rotate pressing against each other so that the top edge of the recording paper 56 begins to be fed held between both of them.

When the paper 56 has been sensed at step S6, at step 58 the paper feed motor 10 is rotated by a fixed amount so that the print start line comes to the front of the head 65. Then, at step S9, the paper feed line counter 354 is reset to 0.

The situation at this time is shown in FIG. 8C or in FIG. 14B.

At step S10, the carriage 27 or the carriage 229 are moved towards the home position.

In the embodiment in FIG. 2, with the movement of the carriage 27 in the direction A, the bottom edge **59*s* of the slide holder 59 and the projection 50*a* of the paper set lever 50 disengage, and the paper set lever 50 is pulled in the direction A by the spring 51 so that the arm 13 also rotates in the direction I and returns to its original position shown in FIG. 8D, and the paper hold roller 15 presses against the platen 1 via the recording paper 56**.

In the embodiment in FIG. 12, with the movement in the direction B, the contact between the cam **229*a* and the projection 225*a* is disengaged, so that the arms 225 and 226 are returned to their original positions by the force of the spring 255, and the paper hold roller 223 and the platen 1 make contact holding the recording paper 56 between them as shown in FIG. 14**C.

The setting of the recording paper 56 is completed in these situations.

A procedure can be implemented to feed the recording paper 56 for a fixed amount to take up any slack in the paper 56 (see FIGS. 7 and 7E).

When the paper feed switch 342 is pressed in the condition when the recording paper 56 is set, for paper feeding by one page at step S11 the timer T2 built in to the CPU **350*c* is set to 0, and counting is begun. After the paper 56 has been fed by one line at step S12, the count value of the paper feed line counter 354** is increased by one at step S13. The value of the line counter 354 is taken to be the correct stored feed position of the set recording paper 56. Next, the on condition of the paper feed switch 342 is judged at step S14, and the procedure advances to step S15.

At step S15, T2max that is the threshold value for distinguishing between page feeding and continuous feeding is compared with the value of the timer T2, and if the value of the timer T2 exceeds T2max, it is judged at step S16 whether or not a feed hole has been sensed to check if the fan-fold paper 56*b* is set as the recording paper 56 or not. When the recording paper 56 is the fan-fold paper 56*b*, the procedure advances to step S17 and executes a page feed. The page feed involves automatically feeding the fan-fold paper 56*b* from the print unit page currently being printed to the print start line of the next print unit page.

At step S17 after a paper feed has been performed by one line, the value of the line counter (LC) 354 is increased by one step S18. At step S19, the value of the line counter (LC) 354 is compared with a predetermined print line number (LCmax) corresponding to the recording paper 56, and paper feeding is performed until the value of LC reaches LCmax. The value of LCmax is set for the maximum number of lines which can be printed on the unit page of fan-fold paper 56*b* excluding the upper and lower margins affixed to avoid the perforations.

When the value of the line counter (LC) 354 reaches LCmax, at step S20 the fan-fold paper is fed by one page to the print start position on the next unit page. When the page feed is executed, at step S21 the line counter (LC) 354 is reset to 0. In this way, the perforations are passed over, and the procedure moves to the next print condition.

As described above, the paper feed switch 342 serves the paper feed function in the condition when the recording paper 56 is set. If the paper feed switch 342 is pressed repeatedly, the paper 56 is fed by one line each time the switch 342 is pressed, and if the paper feed switch 342 is pressed continuously, the paper 56 will feed continuously while the switch 342 is being pressed. Furthermore, when the paper feed switch 342 is pressed continuously in the case of fan-fold paper 56*b*, page feeding can be performed to feed the recording paper 56*b* automatically to the print start position, passing over the next perforations, so that a single paper feed switch 342 is adequate.

Moreover, the paper detector 42 is disposed in a position corresponding to the feed holes 56*h* on fan-fold paper 56*b* and counts the number of feed holes 57*h*, so that the position of perforations on fan-fold paper 56*b* can be ascertained without using a paper feeding means such as a pin feeder or tractor feeder, thereby making it possible to compensate for the accumulated paper feed errors by using frictional force alone.

In the example in FIG. 12, though recording paper 56 is inserted through a single insertion opening regardless of whether it is fan-fold paper 56*b* or cut sheets 56*a*, the respective insertion openings a fan-fold paper 56*b* and cut sheets 56*a* can be arranged. On the other hand, the example in FIG. 2 can also be arranged so as to have a single insertion opening.

Moreover, in the explanation of the present embodiment, cut sheets 56*a* and fan-fold paper 56*b* were used as the recording paper 56. However, roll paper can also be used as the recording medium, or a recording medium of a material other than paper, for instance film, can also be used.

Furthermore, the arrangement for setting and transporting recording medium according to the present invention is not limited to printers of the dot impact type that use an ink ribbon 63 like those in the present embodiments, but could also be applied to any type of printer.

As explained above, the printer according to the present invention is arranged so that the paper hold roller 15 or 223 is linked to the movement of the carriage 27 or 229 and can move away from the platen 1, so that parts such as a special drive source are not necessary, and consequently a simple arrangement with excellent ease of operation is provided.

Moreover, the paper detector 42 for sensing the top edge and bottom edge of the recording paper 56, and the presence of the recording paper 56 is disposed on the head 65 side of the pinch roller 44 or 236. Because this arrangement is such that the recording paper 56 passes the paper detector 42 after it has been held once by the pinch roller 44 or 236 and the platen 1, the sensing of the top edge of the recording paper 56 is performed accurately, and a mechanism such as a positioner is unnecessary during paper setting, thereby realizing a simple configuration as well as reducing costs.

Furthermore, as the paper detector 42 is disposed in a position corresponding to the feed holes 56*h* of the fan-fold paper 56*b* permit counting of the feed holes 56*h*, when fan-fold paper 56*b* is used as the recording paper 56, no accumulated error occurs in the paper feed pitch, and paper feeding is performed by the force of friction alone.

Consequently, even when using fan-fold paper 56*b* conventional means such as a pin wheel are unnecessary, and the number of parts decreases and operability improves.

Because it is possible to count the number of feed holes 56*h* on fan-fold paper 56*b* with the paper detector 42, even when paper feed is performed by manually rotating the platen 1, it is possible to prevent skipping of the perforations or changes in the position of the perforations when feeding to top of form.

Furthermore, the paper feed switch 342 can be used for paper setting, for single line feeding and for continuous feeding (top of form feed) so that the number of switches is reduced, the construction is simple and inexpensive, and the ease of operation is improved.

Moreover, the installation of a guide member 60 to guide the ink ribbon 63 close to the recording head 65 eliminates the need for a guide member such as an arm on the ink ribbon cassette 64 to guide the ink ribbon 63 close to the recording head 65, thereby making it possible to simplify the construction of the ink ribbon cassette 64 and to reduce its size, as well as making it possible to improve the operability when installing the ink ribbon cassette 64.

In addition, because this arrangement is such that the ink ribbon 63 moves up and down with the movement of the carriage 27, making it possible to perform color selection, no special drive source is needed, and consequently the ink ribbon switching arrangement is simplified, and an inexpensive printer with a small number of parts is obtained.

What is claimed is:

1. A printer comprising:

a recording head for performing recording on a recording medium;

a carriage carrying said recording head for reciprocating said recording head in a predetermined direction within a predetermined range;

a platen extending in said predetermined direction, said platen successively feeding said recording medium to a recording area opposite said recording head;

holding means for pressing said recording medium against said platen in the vicinity of said recording area;

supporting means for supporting said holding means so that said holding means can be pressed against and detached from said platen;

a mechanism co-operatively coupled to said carriage and a portion of said supporting means for transferring the moving frame of said carriage to said supporting means thereby pressing and detaching said holding means against and from said platen, said mechanism releasing said holding means from a condition wherein said holding means is pressed against said platen when said carriage is within a predetermined range portion at an end of said predetermined range; and controlling means for controlling the drive of said platen and said carriage, said controlling means having a first mode for driving said platen by a first amount of movement when said carriage is within said predetermined range and a second mode for driving said platen by a second amount smaller than said first amount when said carriage is outside of said predetermined range.

2. A printer as claimed in claim 1, wherein said platen is in the form of a platen roller.

3. A printer as claimed in claim 2, wherein said holding means has a shaft extending in a direction parallel to said platen roller, and a holding roller mounted on said shaft opposite said platen roller; and said supporting means includes a pair of arm members which support both ends of said shaft and which rotate in a first direction in which said holding roller is pressed against said platen roller, and in a second direction in which said holding roller is detached from said platen roller, said supporting means further including an energizing member for urging said pair of arm members in said first direction.

4. A printer as claimede in claim 1, wherein said mechanism has a cam portion provided in said carriage and a protruding portion protruding from said supporting means so that said protruding portion is engageable with said cam portion.

5. A printer as claimed in claim 4, further comprising an energizing means for pressing said holding means against said platen, said mechanism releasing said holding means from said platen against said energizing means.

6. A printer comprising:

a chassis:

a transporting member engageable with an ink ribbon cassette, said ink ribbon cassette having a containing portion for containing an ink ribbon in a manner such that the contained ink ribbon is exposed between an inlet and an outlet of said containing portion, said transporting member transporting said ink ribbon to successively expose said ink ribbon between said outlet and said inlet;

a recording head for performing recording, said recording head contacting a recording medium via said ink ribbon;

a platen extending in a predetermined direction, said platen controlling said recording medium to form a recording area opposite said recording head;

a carriage carrying at least said recording head and reciprocally moving within a predetermined range along said platen;

a switching mechanism for switching positions of said ink ribbon with respect to said recording head, said switching mechanism including a first portion supported on said chassis and a second portion on said carriage, said switching mechanism switching the position of said ink ribbon in accordance with a force resulting from movement of said carriage when said carriage is in a first region within said predetermined range;

a holding member for pressing said recording medium against said platen in the vicinity of said recording area;

a supporting member for supporting said holding member so that said holding member is pressed against and detached from said platen; and a transferring mechanism for transferring the moving force of said carriage to said supporting member to press and detach said holding member against and from said platen, said transferring mechanism including a third portion on said carriage and a portion of said supporting member, said transferring mechanism releasing said holding member from a condition wherein said holding member is pressed against said platen when said carriage is in a second region of said predetermined range.

7. A printer as claimed in claim 6, wherein said platen is in the form of a platen roller for feeding said recording medium.

8. A printer as claimed in claim 7, wherein said holding member has a shaft extending parallel to said platen roller, and a holding roller mounted on said shaft opposite said platen roller; and said supporting member includes a pair of arm members which support both ends of said shaft and which rotate in a first direction in which said holding roller is pressed against said platen roller, and in a second direction in which said holding roller is detached from said platen roller, said supporting member further including an energizing member for urging said pair of arm members in said first direction.

9. A printer as claimed in claim 8, wherein an engaging member is disposed in the vicinity of said arm members for driving said arm members in an engaging direction, and said engaging member has a drive control member disposed on said carriage to control movement of said engaging member in said engaging direction.

10. A printer as claimed in claim 8, which further includes a locking member having a locking position and an opposing position changing member, said opposing position changing member having a cam member for changing the locking position of said locking member in relation to the position of said carriage within said predetermined range.

11. A printer as claimed in claim 10, wherein said ink ribbon has a plurality of color band zones in the transverse direction thereof, and any one of said color band zones is positioned opposite said recording head in response to a change in said locking position.

12. A printer as claimed in claim 11, wherein said ink ribbon has a cleaning band for cleaning said recording head; and said opposing position changing member has a member for disengaging the locking by said locking member at a position preceding the entrance of said carriage into said predetermined range so that said cleaning band is positioned opposite said recording head in response to the release of said locking member.

13. A printer as claimed in claim 12, wherein said drive control member is mounted on a displacing member, said drive control member engaging said engaging member when said carriage has moved to said predetermined position and said locking member is released.

14. A printer as claimed in claim 6, wherein said transferring mechanism has a cam portion provided in said carriage and a protruding portion protruding from said member so that said protruding portion is engageable with said cam portion.

* * * * *